US011106149B2

(12) United States Patent
Mine et al.

(10) Patent No.: US 11,106,149 B2
(45) Date of Patent: Aug. 31, 2021

(54) IMAGE FORMING METHOD

(71) Applicant: Konica Minolta, Inc., Tokyo (JP)

(72) Inventors: Tomoko Mine, Hino (JP); Michiyo Fujita, Hachioji (JP); Ryuichi Hiramoto, Kobe (JP); Kaori Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/779,803

(22) Filed: Feb. 3, 2020

(65) Prior Publication Data

US 2020/0285162 A1 Sep. 10, 2020

(30) Foreign Application Priority Data

Mar. 7, 2019 (JP) ..... JP2019-041585

(51) Int. Cl.
*G03G 9/08* (2006.01)
*G03G 9/097* (2006.01)

(52) U.S. Cl.
CPC ..... *G03G 9/0827* (2013.01); *G03G 9/0819* (2013.01); *G03G 9/0821* (2013.01); *G03G 9/09708* (2013.01); *G03G 9/09725* (2013.01)

(58) Field of Classification Search
CPC ..... G03G 9/0827; G03G 9/0819; G03G 9/09708; G03G 9/09725
USPC ..... 430/108.6, 111.4
See application file for complete search history.

(56) References Cited

U.S. PATENT DOCUMENTS

2009/0258312 A1* 10/2009 Hayata ..... G03G 9/09791 430/125.3
2011/0229812 A1* 9/2011 Takahashi ..... G03G 9/1134 430/105

FOREIGN PATENT DOCUMENTS

| | | | |
|---|---|---|---|
| JP | 4000756 | B2 | 10/2007 |
| JP | 2008-076435 | A | 4/2008 |
| JP | 2016-103004 | A | 6/2016 |
| JP | 2017-138590 | A | 8/2017 |
| JP | 2018-004960 | A | 1/2018 |

* cited by examiner

*Primary Examiner* — Mark A Chapman
(74) *Attorney, Agent, or Firm* — Lucas & Mercanti, LLP

(57) ABSTRACT

Provided is an image forming method using an electrophotographic photoreceptor provided with a photosensitive layer and a protective layer in this order on a conductive support, and a toner, and the image forming method containing a charging step, an exposure step, a development step, a transfer step, a fixing step, and a cleaning step, wherein the protective layer contains at least a cured resin obtained by curing a polymerizable compound; the toner contains 50% by number or more of toner particles having a shape factor calculated by the equation (1) in the range of 1.2 to 1.6, and a variation coefficient of the shape factor is 16% or less; and the toner contains alumina particles having a number average particle diameter in the range of 5 to 60 nm and silica particles having a number average particle diameter in the range of 80 to 200 nm.

8 Claims, 1 Drawing Sheet

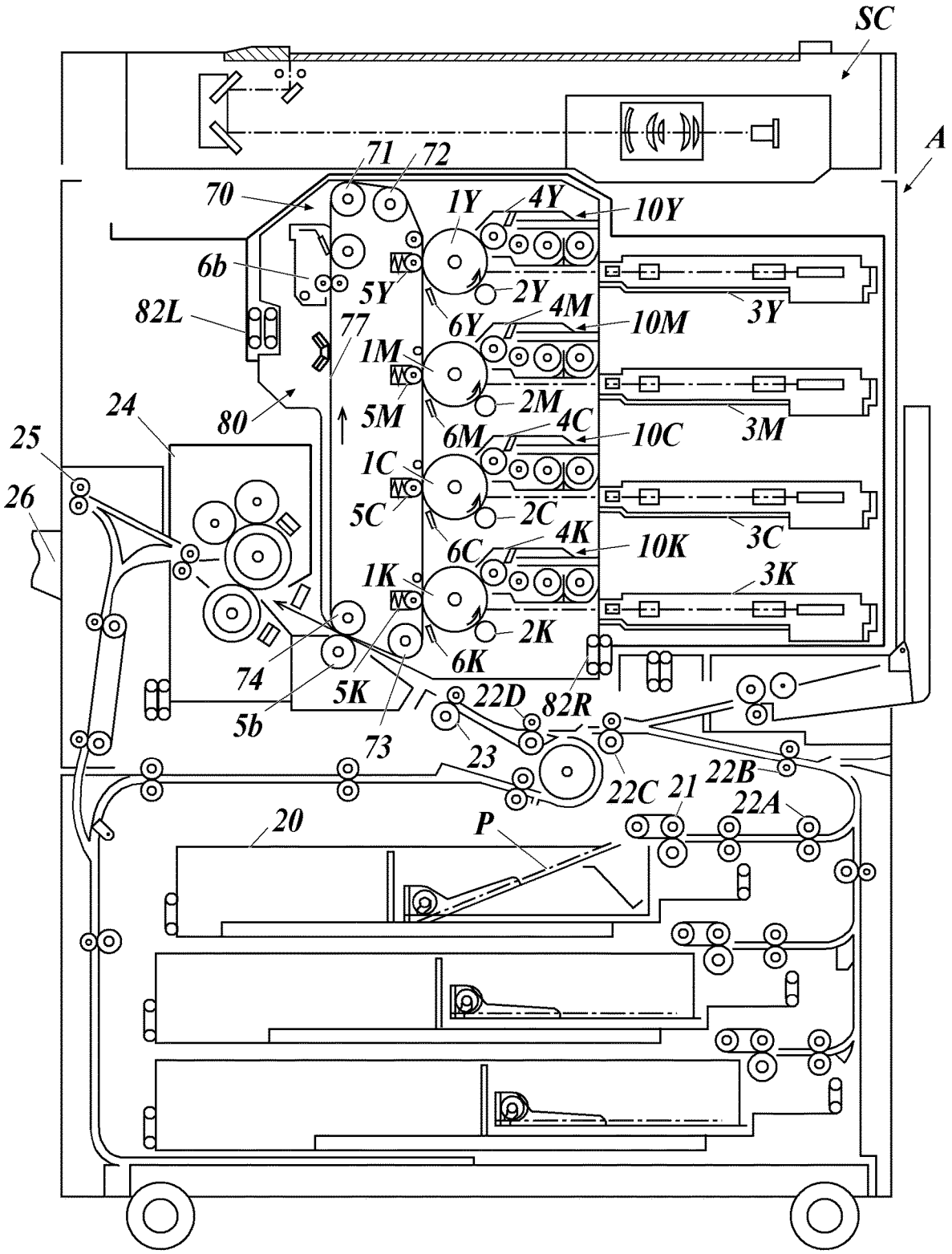
SC
A
71
72
70
1Y
4Y
10Y
6b
5Y
2Y
4M
10M
3Y
82L
77
6Y
1M
2M
4C
10C
3M
24
80
5M
6M
25
1C
26
5C
2C
4K
10K
3C
6C
1K
3K
2K
6K
74
5K
22D
82R
5b
73
23
22C
21
22B
22A
20
P

IMAGE FORMING METHOD

CROSS-REFERENCE TO RELATED APPLICATION

The entire disclosure of Japanese Patent Application No. 2019-041585 filed on Mar. 7, 2019 with Japan Patent Office is incorporated herein by reference in its entirety.

BACKGROUND

1. Technological Field

The present invention relates to an image forming method. More particularly, the present invention relates to an image forming method capable of maintaining a cleaning property even during long-term continuous use, and suppressing image flow, image defects due to a decrease in toner charge amount, and in-machine contamination due to volatile components in the release agent.

2. Description of the Related Art

In recent years, opportunities for continuous output of high-quality printed materials in electrophotography are increasing, and it is required to maintain the photoreceptor performance over a long period of time while ensuring toner cleaning properties. For such a problem, there are proposed a method of ensuring cleaning properties by making the toner shape non-spherical (for example, see Japanese Patent No. 4000756), or a method in which a photoreceptor is provided with a cured surface layer (also referred to as a "protective layer") to impart scratch resistance and wear resistance to achieve a long life of the photoreceptor (for example, JP-A 2018-4960). However, in the case of a photoreceptor having a hardened surface layer, it is difficult to remove the discharge product together with the surface layer during cleaning because the surface is difficult to scrape. When used for a long period of time, the discharge product adhering to the surface of the photoconductor may absorb moisture in a high temperature and high humidity environment, resulting in a decrease in surface resistance and image blurring. As a method for polishing the surface of a photoreceptor having a hardened surface layer, a method of polishing the surface with a wrap film containing alumina particles is known (see, for example, JP-A 2008-76435). On the other hand, alumina is also used as an external additive for toner (see, for example, JP-A 2017-138590). Therefore, if a toner with external addition of alumina particles is used, a photoreceptor having a hardened surface layer is also polished. It is considered that the effect is exerted and the discharge product will be removed. However, since alumina has a relatively low specific gravity, adhesion to toner is weak. In particular, when a non-spherical toner having excellent cleaning properties as described above is used, alumina is unevenly distributed in the recessed portion of the toner surface due to stress caused by stirring in the developing machine, and it was difficult to obtain a sufficient polishing effect. In addition, since alumina has a low resistance value, when transferring to a carrier during high coverage printing, the charge transfer of the carrier is promoted to reduce the charge amount of the toner, and a desired image density may not be obtained.

In recent years, a release agent having a low melting point is often used to achieve low-temperature fixing (see, for example, JP-A 2016-103004).

SUMMARY

However, since the low melting point release agent has a low molecular weight, when the toner is heated in the fixing process, a volatile component is likely to be generated, and this volatile component contaminates the inside of the image forming apparatus.

The present invention has been made in view of the above-described problems and circumstances, and an object of the present invention is to provide an image forming method capable of maintaining a cleaning property even in long-term continuous use on a photoreceptor having a protective layer, and suppressing image flow, image defects due to a decrease in toner charge amount, and in-machine contamination due to volatile components in the release agent.

To achieve at least one of the above-mentioned objects according to an aspect of the present invention, an image forming method reflecting one aspect of the present invention is a method of using an electrophotographic photoreceptor provided with a photosensitive layer and a protective layer in this order on a conductive support, and a toner, and the image forming method comprising a charging step, an exposure step, a development step, a transfer step, a fixing step, and a cleaning step, wherein the protective layer contains at least a cured resin obtained by curing a polymerizable compound; the toner contains 50% by number or more of toner particles having a shape factor calculated by the following equation (1) in the range of 1.2 to 1.6, and a variation coefficient of the shape factor is 16% or less; and the toner contains alumina particles having a number average particle diameter in the range of 5 to 60 nm and silica particles having a number average particle diameter in the range of 80 to 200 nm, $$\text{Shape factor}=[(\text{Maximum diameter}/2)^2\times\pi)]/(\text{Projection area}), \quad \text{Equation (1):}$$

wherein "Maximum diameter" indicates a width of a particle that maximizes an interval between two parallel lines when a projected image of the toner particles on a plane is sandwiched between the two parallel lines; and "Projection area" indicates an area of the projected image of the toner particles on the plane.

BRIEF DESCRIPTION OF THE DRAWING

The advantages and features provided by one or more embodiments of the invention will become more fully understood from the detailed description given hereinbelow and the appended drawing which is given by way of illustration only, and thus are not intended as a definition of the limits of the present invention.

The FIGURE is a schematic cross-sectional view illustrating a structure of a tandem type electrophotographic image forming apparatus according to an embodiment of the present invention.

DETAILED DESCRIPTION OF THE EMBODIMENTS

Hereinafter, one or more embodiments of the present invention will be described by referring to the drawing. However, the scope of the invention is not limited to the disclosed embodiments.

By the above-described means of the present invention, it is possible to provide an image forming method with the photoreceptor having a protective layer capable of maintaining a cleaning properties even during long-term continuous use, and suppressing image flow, image defects due to a decrease in toner charge amount, and in-machine contamination due to volatile components in the release agent.

The expression mechanism or action mechanism of the effect of the present invention is not clear, but it is presumed as follows. By being provided with a photoreceptor having a protective layer containing a cured resin obtained by curing a polymerizable compound, wear resistance and scratch resistance are improved, and a good image is obtained over a long period of time. In addition, toner particles having a specific shape having a shape factor in the range of 1.2 to 1.6 have a slightly flat shape or a shape having irregularities as compared with a true sphere having the same projected area. Since such toner particles have a small area in contact with the photoreceptor, the cleaning property becomes good. Further, when a toner to which alumina particles are externally added is used, alumina particles having a high Mohs hardness act as an abrasive on the protective layer of the photoreceptor, and discharge products are removed. As a result, the occurrence of image flow will be suppressed even during long-term use. Further, since the alumina particles used as an external additive have a small diameter of 5 to 60 nm, the adhesion force to the surface of the toner mother particles is strong. For this reason, even when subjected to stress such as agitation in the developing machine, the non-spherical toner is hardly unevenly distributed, and the polishing effect is maintained. As a result, the occurrence of image flow will be suppressed even during long-term use. In particular, the toner particles having the specific shape have a slightly flat or uneven surface, and therefore are difficult to roll on the photoreceptor. Therefore, the surface of the photoreceptor is easily rubbed by the toner surface, and the effect of polishing by the alumina particles existing on the toner surface is easily obtained. As a result, the occurrence of image flow will be reliably suppressed. Further, since the alumina particles have a small diameter of 5 to 60 nm, the surface area per unit volume is large, and the adhesion to the toner is strong. Therefore, it is difficult for the carrier to shift, and a decrease in charge amount is suppressed even during high coverage printing, and a good image will be obtained. Further, since the silica particles have a large diameter of 80 to 200 nm, they act as spacers. Therefore, it becomes difficult to receive stress due to stirring in the developing machine, and the alumina particles are less likely to be unevenly distributed in the concave portion of the toner surface. As a result, it is presumed that a good image will be obtained without image flow even during long-term use.

In addition, when a photoreceptor having a protective layer is used, or when a toner having the shape as in the present invention is used, in some cases, the inside of the copying machine is contaminated by the volatilized release agent dust, or dust generation to the outside due to exhaust is increased. However, the above-described means of the present invention makes it possible to suppress the generation of dust from such a release agent. The expression mechanism or action mechanism is not clear, but is presumed as follows. The toner particles may be microcracked on the surface when subjected to a mechanical impact. When such toner particles are used, the release agent component tends to volatilize from minute cracks due to heating during fixing. In particular, since the surface of a photoreceptor having a protective layer is relatively hard, the impact received when toner particles are electrostatically attached to the surface of the photoreceptor is large, and microcracks tend to occur. Further, in the toner particles according to the present invention, since the shape of the toner particles is flat or uneven, when a mechanical impact is applied, stress is concentrated in the recesses and microcracks are likely to occur. However, in the present invention, since the alumina particles having a high Mohs hardness adhere to the toner surface, the apparent hardness of the toner particles is larger than when no alumina particles are used. For this reason, even when subjected to a mechanical impact, it is considered that minute cracks are hardly generated on the surface of the toner particles, and volatilization of the release agent component is suppressed.

The image forming method of the present invention uses an electrophotographic photoreceptor provided with a photosensitive layer and a protective layer in this order on a conductive support, and a toner, and the image forming method contains at least a charging step, an exposure step, a development step, a transfer step, a fixing step, and a cleaning step, wherein the protective layer contains at least a cured resin obtained by curing a polymerizable compound; the toner contains 50% by number or more of toner particles having a shape factor calculated by the above-described equation (1) in the range of 1.2 to 1.6, and a variation coefficient of the shape factor is 16% or less; and the toner contains alumina particles having a number average particle diameter in the range of 5 to 60 nm and silica particles having a number average particle diameter in the range of 80 to 200 nm. This feature is a technical feature common to or corresponding to each of the following embodiments.

As an embodiment of the present invention, when the toner contains 65% by number or more of toner particles having the shape factor in the range of 1.2 to 1.6, the load applied to the cleaning blade becomes more uniform. This is preferable from the viewpoint of ensuring cleaning properties during long-term use.

The content of the alumina particles is preferably in the range of 0.1 to 3.0 mass parts with respect to the whole toner mother particles from the viewpoint that it has an excellent polishing effect on the surface of the photoreceptor, has good adhesion to the toner surface, and suppress image defects due to carrier transfer. The content of the silica particles is preferably in the range of 0.1 to 3.0 mass parts with respect to the whole toner mother particles from the viewpoint that a sufficient spacer effect will be obtained without detachment from the toner.

The volume average particle diameter of the toner particles is preferably in the range of 3.0 to 6.5 μm from the viewpoint of excellent polishing effect on the surface of the photoreceptor by the alumina particles on the toner surface.

It is preferable that the protective layer contains at least inorganic fine particles from the viewpoint of improving the mechanical strength of the protective layer of the photoreceptor and contributing to a long life. When the number average particle diameter of the inorganic fine particles is within the range of 0.1 to 0.5 μm, the strength of the protective layer of the photoreceptor will be sufficiently increased. Moreover, it is preferable from the viewpoint that a high quality image is obtained without inhibiting light transmission.

The present invention and the constitution elements thereof, as well as configurations and embodiments to carry out the present invention, will be detailed in the following. In the present description, when two figures are used to indicate a range of value before and after "to", these figures are included in the range as a lowest limit value and an upper limit value.

[Outline of Image Forming Method of the Present Invention]

The image forming method of the present invention uses an electrophotographic photoreceptor provided with a photosensitive layer and a protective layer in this order on a conductive support, and a toner, and the image forming method contains at least a charging step, an exposure step, a development step, a transfer step, a fixing step, and a cleaning step, wherein the protective layer contains at least a cured resin obtained by curing a polymerizable compound; the toner contains 50% by number or more of toner particles having a shape factor calculated by the above-described equation (1) in the range of 1.2 to 1.6, and a variation coefficient of the shape factor is 16% or less; and the toner contains alumina particles having a number average particle diameter in the range of 5 to 60 nm and silica particles having a number average particle diameter in the range of 80 to 200 nm.

The charging step, exposure step, development step, transfer step, fixing step, and cleaning step are steps used in a general electrophotographic image forming method. Specifically, the charging step is a step of charging the electrophotographic photosensitive member, the exposure step is a step of forming an electrostatic latent image on the electrophotographic photoreceptor, and the developing step is to develop the electrostatic latent image with a toner to form a toner image. The transfer step is a step of transferring the toner image to a transfer material, and the fixing step is a step of fixing the unfixed image on the transfer material by heating, or pressurizing on the transfer material onto which the unfixed image formed using the toner is transferred. The cleaning step is a step of removing from the developer carrying member the developer that has not been used for image formation or remained on the developer carrying member such as a photoreceptor or an intermediate transfer member.

<Shape Factor of Toner Particles>

The shape factor of the toner particles according to the present invention indicates the degree of roundness of the toner particles. This is calculated by taking a photograph in which the toner particles are enlarged 2000 times with a scanning electron microscope and analyzing the image using an image processing analyzer "LUZEX AP" (manufactured by Nireco Corporation)). At this time, toner particles that are not visible to the whole, such as except toner particles that overlap under the other toner particles and toner particles at the edge of the field of view, are excluded. And randomly select and measure 100 toner particles from the whole visible particles. From the photographic image obtained above, the shape factor is calculated by the following equation (1).

$$\text{Shape factor}=[(\text{Maximum diameter}/2)^2\times\pi)]/(\text{Projection area}) \qquad \text{Equation (1):}$$

In the equation, the terms are defines as follows.

Maximum diameter: a width of a particle that maximizes an interval between two parallel lines when a projected image of the toner particles on a plane is sandwiched between the two parallel lines; and Projection area: an area of the projected image of the toner particles on the plane.

The toner according to the present invention contains 50% by number or more of toner particles having a shape factor in the range of 1.2 to 1.6. Preferably it is 65% by number or more, and still more preferably it is 70% by number or more. Within the above range, the load applied to the cleaning blade becomes uniform, and the cleaning property is ensured even during long-term use. When there are many toner particles having a shape factor is smaller than 1.2, the toner particle shape tends to be nearly spherical, so that the toner easily rolls on the surface of the photoreceptor during cleaning, and has a rubbing action on the photoreceptor surface is not fully demonstrated. As a result, the discharge product is not sufficiently removed, and image flow is likely to occur. In addition, when there are many toner particles having a shape factor larger than 1.6, it is considered that there are many toner particles having an excessively uneven shape or an excessively flat shape. In such toner, it is difficult for the external additive to adhere uniformly, and the toner charge amount tends to decrease. In addition, cracks on the particle surface due to stress and cracking of the particle itself are likely to occur. This will results in in-machine contamination due to the generation of volatile components derived from the release agent, and excessive image density, as a result, image defects such as fogging become easily occur.

The method for controlling the shape factor is not particularly limited. Examples of the method for controlling the shape factor in the range of 1.2 to 1.6 are: a method in which toner particles are sprayed into a hot air flow, a method in which toner particles are repeatedly applied with mechanical energy due to impact force in a gas phase, and a method in which a toner is not dissolved in a solvent and a swirl flow is applied, then, adjusting this by adding it to a normal toner so as to be within the scope of the present invention. In addition, there is a method in which the overall shape is controlled at the stage of preparing a so-called polymerization method toner, and a toner prepared in the range of a shape factor in the range of 1.2 to 1.6 is similarly added to a normal toner for adjustment. Among the above methods, the polymerization toner is preferable because it is simple as a production method and has excellent surface uniformity as compared with the pulverized toner.

<Variation Coefficient of Shape Factor>

A variation coefficient of a shape factor of the toner particles according to the present invention is calculated from the following equation (2).

$$\text{Coefficient of variation}=(S_1/K)\times 100(\%) \qquad \text{Equation (1):}$$

In the equation, Si represents a standard deviation of a shape factor of 100 randomly selected toner particles, and K represents an average value of the shape factor.

The variation coefficient of the shape factor is preferably 16% or less, more preferably 14% or less. When it is 16% or less, the shape becomes uniform, so that developability is uniform and image density unevenness will be suppressed. In order to uniformly control the shape factor and the variation coefficient of the shape factor without variation of lots, in the step of polymerizing, fusing and controlling the shape of the resin particles (polymer particles), an appropriate process end time may be determined while monitoring the characteristics of the toner particles (colored particles) being formed.

<Alumina Particles>

The toner according to the present invention contains alumina particles having a number average particle diameter in the range of 5 to 60 nm. Preferably, it is in the range of 10 to 40 nm, and more preferably it is in the range of 10 to 25 nm. When it is 5 nm or more, a sufficient polishing effect will be obtained on the surface of the photoreceptor. When it is 60 nm or less, the surface area with respect to the volume is increased, the adhesion to the toner surface is increased, and the apparent hardness of the surface of the toner particles is improved, thereby suppressing in-machine contamination due to volatilization of the release agent.

Further, it is possible to prevent the occurrence of image defects due to carrier transfer.

The added amount of the alumina particles is preferably in the range of 0.1 to 3.0 mass parts with respect to the entire toner mother particles. When the added amount is 0.1 mass parts or more, a sufficient polishing effect will be obtained. When the added amount is 3.0 mass parts or less, carrier transfer is difficult, and image defects due to a decrease in toner charge amount will be prevented.

<Silica Particles>

The toner according to the present invention contains silica particles having a number average particle diameter in the range of 80 to 200 nm. Preferably, it is in the range of 80 to 150 nm, and more preferably it is in the range of 90 to 120 nm. When it is 80 nm or more, a sufficient spacer effect is obtained, and when it is 200 nm or less, it is difficult to detach from the toner, and also in this respect, a sufficient spacer effect is obtained.

The content of the silica particles is preferably in the range of 0.1 to 3.0 mass parts with respect to the entire toner mother particles. When the amount is 0.1 mass parts or more, a sufficient spacer effect is obtained, and when the amount is 3.0 mass parts or less, the toner surface easily comes into contact with the surface of the photoreceptor, and the surface of the photoreceptor is sufficiently polished.

The number average particle diameter of the alumina particles and the silica particles may be measured as follows. Using a scanning electron microscope (SEM) "JSM-7401F" (manufactured by JEOL Ltd.), a SEM photograph magnified 50,000 times is taken with a scanner. With the image processing analyzer "LUZEX AP" (manufactured by Nireco Corporation), for 100 alumina particles or silica particles in the SEM photograph image are binarized, the ferret diameter in the horizontal direction is calculated, and the average value is defined as the number average particle diameter.

[Toner]

In the image forming method of the present invention, the toner includes toner mother particles and at least alumina particles and the silica particles as an external additive externally added to the toner mother particles. In this specification, "toner mother particles" constitutes a base of "toner particles". The "toner mother particles" contain at least a binder resin, and may contain other components such as a colorant, a release agent (wax), and a charge controlling agent as necessary. The "toner mother particles" are referred to as "toner particles" by adding an external additive. The "toner" refers to an aggregate of "toner particles".

<Toner Mother Particles>

The composition and structure of the toner mother particles are not particularly limited, and known toner mother particles may be appropriately employed. Examples thereof include toner mother particles described in JP-A 2018-72694 and JP-A 2018-84645.

The binder resin is not particularly limited, and examples thereof include an amorphous resin or a crystalline resin. In this specification, an amorphous resin means a resin having a relatively high glass transition temperature (Tg) without having a melting point when differential scanning calorimetry (DSC) is performed. The amorphous resin is not particularly limited, and a known amorphous resin may be used. For example, a vinyl resin, an amorphous polyester resin, a urethane resin, and a urea resin may be cited. Among these, a vinyl resin is preferable from the viewpoint of easy control of thermoplasticity.

The vinyl resin is not particularly limited as long as a vinyl compound is polymerized, and examples thereof include a (meth)acrylate resin, a styrene-(meth)acrylate resins, and an ethylene-vinyl acetate resins. In this specification, a crystalline resin refers to a resin having a clear endothermic peak instead of a stepwise endothermic change in differential scanning calorimetry (DSC). The clear endothermic peak specifically means a peak whose half-value width of the endothermic peak is within 15° C. when measured at a rate of temperature increase of 10° C./min in differential scanning calorimetry (DSC).

The crystalline resin is not particularly limited, and a known crystalline resin can be used. Examples thereof include a crystalline polyester resin, a crystalline polyurethane resin, a crystalline polyurea resin, a crystalline polyamide resin, and a crystalline polyether resin. Among these, it is preferable to use a crystalline polyester resin. Here, the "crystalline polyester resin" is obtained by a polycondensation reaction of a divalent or higher carboxylic acid (polyvalent carboxylic acid) and a derivative thereof with a divalent or higher alcohol (polyhydric alcohol) and a derivative thereof. Among known polyester resins, the resin satisfying the endothermic characteristics as described above may be used. These resins may be used alone or in combination of two or more.

The colorant is not particularly limited, and a known colorant may be used. For example, carbon black, a magnetic substance, a dye, and a pigment may be mentioned.

The release agent is not particularly limited, and a known release agent may be used. For example, a polyolefin wax, a branched chain hydrocarbon wax, a long chain hydrocarbon wax, a dialkyl ketone wax, an ester wax, and an amide wax may be mentioned.

The charge controlling agent is not particularly limited, and a known charge controlling agent may be used. Examples thereof include nigrosine dyes, metal salts of naphthenic acid or higher fatty acids, alkoxylated amines, quaternary ammonium salt compounds, azo metal complexes, and salicylic acid metal salts or metal complexes.

The toner mother particles may be toner particles having a multilayer structure such as a core-shell structure including a core particle and a shell layer covering the surface of the core particle. The shell layer may not cover the entire surface of the core particle, and the core particle may be partially exposed. The cross section of the core-shell structure is confirmed by a known observation means such as a transmission electron microscope (TEM) or a scanning probe microscope (SPM).

(Volume Average Particle Diameter of Toner Particles)

It is preferable that the toner particles have a volume average particle diameter in the range of 3.0 to 8.0 μm, more preferably in the range of 3.0 to 6.5 μm. From the viewpoint of ease of manufacture, it is preferable to set the volume average particle diameter of the toner particles to 3.0 μm or more. On the other hand, when the particle diameter is 8.0 μm or less, the surface area of the toner with respect to the volume increases, so that the polishing effect on the surface of the photoreceptor by the alumina particles on the toner surface is more easily exhibited.

<<Measuring Method>>

In the present invention, the volume average particle diameter of the toner particles is a volume-based median diameter (D50). It may be measured and calculated by using measuring equipment composed of "MULTISIZER 3" (Beckman Coulter Inc.) and a computer system installed with a data processing software. Specifically, a predetermined amount (0.02 g) of a measuring sample (toner particles) is added to a predetermined amount (20 mL) of surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion. The toner particle dispersion liquid thus prepared is added to "ISOTON II" (Beckman Coulter Inc.) in a beaker placed in sample stand by a pipet until the concentration displayed on the measuring equipment reaches 5 to 10%. The measuring particle count of the measuring equipment is set to be 25,000. The aperture size of the measuring equipment is set to be 100 μm. The measuring range, which is from 1 to 30 μm, is divided into 256 sections to calculate the respective frequencies. The particle diameter where the accumulated volume counted from the largest size reaches 50% is determined as the volume-based median diameter ($D_{50}$). The volume average particle diameter of the toner particles may be controlled by changing the concentration of the aggregating agent, the added amount of organic solvent, or fusing time used in the production.

(Average Circularity of Toner Particles)

It is preferable that the toner particles in the toner of the present invention have an average circularity of 0.995 or less, more preferably 0.985 or less, and still more preferably in the range of 0.93 to 0.97. When the average circularity is within this range, the toner particles are more easily charged. The average circularity of the toner particles is measured with a flow-type particle image analyzer "FPIA-3000" (made by Sysmex Corporation), for example. Specifically, it may be measured by the following method.

<<Measuring Method>>

A measuring sample (toner particles) is wetted in an aqueous surfactant solution, and is ultrasonically dispersed for one minute. After making the dispersion, the average circularity is measured with the analyzer "FPIA-3000" in a high power field (HPF) mode at an appropriate density (the number of particles to be detected at an HPF: 3000 to 10000 particles). This range will provide reproducibility in the measurement. The circularity is calculated from the following expression:

Circularity of toner particle=(Perimeter of a circle having a projected area identical to that of the projected image of a particle)/(Perimeter of the projected image of the particle)

The average circularity indicates the arithmetic average value obtained by dividing the sum of circularities of particles by the number of particles. The average circularity of the toner particles may be adjusted by controlling the temperature or time of the ripening treatment in the above-described production method.

<External Additive>

The toner of the present invention includes the above-described alumina particles and silica particles. The alumina particles and the silica particles as a external additive have a function of reducing electrostatic and physical adhesion between the transfer member and the toner and improving transferability. Further, it has a function of improving the removability of the residual toner to improve the cleaning property and reducing the wear of the photoreceptor and the cleaning blade.

(Alumina Particles)

Alumina refers to aluminum oxide represented by $Al_2O_3$, and forms such as a-type, γ-type, a-type, and mixtures thereof are known. The alumina particles may be produced by a known method such as JP-A 2012-224542 and European Patent No. 0585544. As a method for producing alumina, the Bayer method is generally used, but in order to obtain high-purity and nano-sized alumina, hydrolysis method, gas phase synthesis method, flame hydrolysis method, and underwater spark discharge method may be mentioned.

The number average particle diameter of the alumina particles is in the range of 5 to 60 nm as described above. As described above, the addition amount is preferably in the range of 0.1 to 3.0 mass parts with respect to the entire toner mother particles. The surface of the alumina particles is preferably subjected to a hydrophobic treatment with a surface modifier (surface treatment agent). As a result, fluctuations in the charge amount due to environmental differences and fluctuations in the charge amount when shifting to the carrier may be more effectively suppressed. Examples of a method of hydrophobizing alumina particles with a surface modifier are as follows: a dry method such as a spray drying method of spraying a surface modifier or a solution containing the surface modifier on alumina particles suspended in a gas phase; a wet method in which alumina particles are immersed in a solution containing a surface modifier and drying; and a mixing method in which the surface modifier and alumina particles are mixed with a mixer.

(Silica Particles)

The number average particle diameter of the silica particles according to the present invention is in the range of 80 to 200 nm as described above, and the addition amount is preferably in the range of 0.1 to 3.0 mass parts with respect to the whole toner mother particles as described above.

The large-diameter silica particles as described above are preferably produced by a sol-gel method. Silica produced by the sol-gel method has a larger particle size and a uniform particle size compared to fumed silica which is a general production method (narrow particle size distribution, i.e., monodisperse).

<<Method for Producing Silica Particles by Sol-Gel Method>>

The silica particles according to the present invention may be obtained by a sol-gel method which is a wet method. The true specific gravity may be controlled to be lower than that of the vapor phase oxidation method because it is produced by a wet method and without firing. Further, it is possible to further adjust by controlling the type of hydrophobic treatment agent or the treatment amount in the hydrophobization treatment step. The particle size may be adjusted by controlling sol-gel hydrolysis, alkoxysilane in the polycondensation step, ammonia, alcohol, water mass ratio, reaction rate, stirring rate, and feed rate. Monodispersed and spherical shapes can also be produced by this method.

The silica particles used in the present invention have a number average particle diameter in the range of 80 to 200 nm, and specifically, hydrophobic silica that has been subjected to a hydrophobic treatment is preferable. As a method for producing silica particles according to the present invention, a known method for producing silica particles may be used. In this case, the silica particles according to the present invention are mainly produced through three steps of hydrolysis, polycondensation, and hydrophobic treatment. In addition, other steps such as drying may be combined as necessary.

Next, the outline of the production process of silica particles by the sol-gel method will be described below. First, alkoxysilane is dropped and stirred with applying temperature while adding a catalyst in the presence of water and alcohol. Next, the silica sol suspension obtained by the reaction is centrifuged to separate into wet silica gel, alcohol and aqueous ammonia. A solvent is added to wet silica gel to form a silica sol again, and a hydrophobizing agent is added to hydrophobize the silica surface. Alternatively, after the sol is dried to form a dry sol, a hydrophobizing agent is added, and the silica surface is hydrophobized.

As a hydrophobizing agent, know coupling agents, silicone oils, aliphatic acids, metal salts of aliphatic acids may be used. Next, the silica particles according to the present invention can be obtained by removing the solvent from the hydrophobized silica sol and drying it. Further, the silica particles thus obtained may be subjected to a hydrophobic treatment again.

The following methods may be added: a dry method such as a spray dry method in which a treatment agent or a solution containing a treatment agent is sprayed on particles suspended in a gas phase; a wet method in which particles are immersed in a solution containing a treatment agent and dried; and a mixing method in which treatment agent and particles are mixed by a mixer. As the silane compound used as the hydrophobizing agent, a water-soluble silane compound may be used. As such a silane compound, those represented by the following Structural formula (1) may be used.

$R_aSiX_{4-a}$ Structural formula (1):

In Structural formula (1), a is an integer of 0 to 3, R represents a hydrogen atom, an organic group such as an alkyl group, and an alkenyl group, and X represents a hydrolyzable group such as a chlorine atom, a methoxy group, and an ethoxy group.

Examples of the compound represented by Structural formula (1) include chlorosilane, alkoxysilane, silazane, and special silylation agents. More specific examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane. Particularly preferred examples of the hydrophobizing agent used in the present invention include isobutyltrimethoxysilane, and octyltrimethoxysilane.

Particularly preferable hydrophobizing agent used in the present invention include dimethyldimethoxysilane, hexamethyldisilazane (HMDS), methyltrimethoxysilane, isobutyltrimethoxysilane, and decyltrimethoxysilane.

Specific examples of the silicone oil include cyclic compounds such as organosiloxane oligomers, octamethylcyclotetrasiloxane, decamethylcyclopentasiloxane, tetramethylcyclotetrasiloxane, and tetravinyltetramethylcyclotetrasiloxane; and straight chain or branched chain organosiloxanes. Highly reactive silicone oils having a modified-terminal at least one end may be also used, which is introduced a modified group at one or both ends of the main chain, or one end or both ends of each side chain Examples of the modifying group include, but are not particularly limited to, alkoxy, carboxy, carbinol, modified higher fatty acid, phenol, epoxy, methacrylic, and amino groups. Silicone oils having two or more types of modified groups such as amino and alkoxy modified groups may be also used.

Dimethyl silicone oil may be mixed or combined with one or more of these modified silicone oils, optionally further with one or more of other surface modification agents. Examples of the surface modification agent used with these silicone oils include silane coupling agents, titanate coupling agents, aluminate coupling agents, various silicone oils, fatty acids, metal salts of fatty acids, esterified compounds thereof, and rosin acids.

In the present invention, it is preferable to use a two-component developer containing a toner using the large-diameter silica particles produced as described above and the small-diameter alumina particles as an external additive.

<<Method of Mixing Silica Particles>>

As a method for adhering the silica particles to the surface of the toner mother particles according to the present invention, an ordinary method of adding and mixing external additives to the toner mother particles may be used. For example, as a method for adding silica particles, there is a dry method in which silica particles are added in powder form to dried toner mother particles. As a mixing device, a mechanical mixing device such as a Henschel mixer or a coffee mill may be mentioned. Note that alumina particles may also be adhered to the surface of the toner mother particles in the same manner as silica particles.

(Other External Additives)

The external additive according to the present invention preferably contains other external additives in addition to the alumina particles and the silica particles from the viewpoint of controlling the fluidity and chargeability of the toner particles. Examples of such external additives include titania particles, zirconia particles, zinc oxide particles, chromium oxide particles, cerium oxide particles, antimony oxide particles, tungsten oxide particles, tin oxide particles, tellurium oxide particles, manganese oxide, and boron oxide particles.

The number average particle diameter of the other external additives may be adjusted, for example, by classification or mixing of classified products. The number average particle diameter of other external additives may be measured by the same method as the method for measuring the number average particle diameter of alumina particles described above.

The surface of other external additives is preferably hydrophobized from the viewpoint of improving heat storage stability and environmental stability. A known surface modifier is used for the hydrophobic treatment. Examples of the surface modifier include silane coupling agents, titanate coupling agents, aluminate coupling agents, fatty acids, fatty acid metal salts, esterified products thereof, rosin acid, and silicone oil.

Organic particles may also be used as other external additives. As the organic particles, spherical organic particles having a number average particle diameter of about 10 to 2000 nm may be used. Specifically, homopolymers such as styrene and methyl methacrylate and organic particles of these copolymers may be used. A lubricant may also be used as another external additive. The lubricant is used for the purpose of further improving the cleaning property and transferability. Specific examples thereof includes higher fatty acid metal salts such as: zinc, aluminum, copper, magnesium, or calcium stearate; zinc, manganese, iron, copper, or magnesium oleate; zinc, copper, magnesium, or calcium palmitate; zinc or calcium linolenate; and zinc or calcium ricinoleate.

[Production Method of Toner]

The production method of the toner mother particles according to the present invention is not particularly limited. Examples of the method include known methods such as: a kneading pulverization method, a suspension polymerization, an emulsion aggregation method, a dissolution suspension method, a polyester extension method, and a dispersion polymerization method. Among these processes, preferred is an emulsion aggregation method in view of the uniformity of the particle size and control of the shape of the toner. In the emulsion aggregation method, a dispersion of binder resin particles dispersed with a surfactant or dispersion stabilizer is mixed with a dispersion of colorant particles as necessary to obtain a desired toner particle size. In this method, toner mother particles are manufactured by controlling the shape by agglomeration until the particles are further agglomerated to each other and further fusing the particles of the binder resin. Here, the binder resin particles may optionally contain a release agent and a charge controlling agent.

A mechanical mixing apparatus may be used as the external additive mixing treatment on the toner mother particles. The mechanical mixer used may be a HENSCHEL mixer, a NAUTA Mixer, or a TURBULAR mixer. Among these mixers, a HENSCHEL mixer, which is capable of imparting shear force to the particles, may be used to mix the materials for a longer time or with a stirring blade at a higher circumferential speed of rotation. When several kinds of external additives are used, all of the external additives may be mixed with the toner particles in one batch, or several aliquots of the external additives may be mixed with the toner particles.

[Developer]

The toner may be used as a magnetic or non-magnetic one-component developer, and may be mixed with a carrier and used as a two-component developer. When the toner is used as a two-component developer, the magnetic particles made of known materials may be used as a carrier. Examples the carrier includes a ferromagnetic metal such as iron, an alloy of a ferromagnetic metal with aluminum and lead, a compound of a ferromagnetic metal such as ferrite and magnetite. Ferrite is particularly preferable.

[Electrophotographic Photoreceptor]

The electrophotographic photoreceptor according to the present invention (hereinafter, also referred to as "photoreceptor") has a photosensitive layer formed on a conductive support, and a protective layer formed on the photosensitive layer. Although not particularly limited, specific examples include a layer structure in which a photosensitive layer and a protective layer are laminated in this order as indicated in the following (1) and (2).

(1) A layer structure in which an intermediate layer, a photosensitive layer containing a charge generation layer and a charge transport layer, and a protective layer are laminated in this order on a conductive support.

(2) A layer structure in which an intermediate layer, a single layer containing a charge generation material and a charge transport material as a photosensitive layer, and a protective layer are laminated in this order on a conductive support.

The photoreceptor according to the present invention is an organic photoreceptor, and the organic photoreceptor means an electrophotographic photoreceptor in which at least one of a charge generation function and a charge transport function that is indispensable for the configuration of the electrophotographic photoreceptor is expressed by an organic compound. It includes a photoreceptor composed of a known organic charge generation material or organic charge transport material, and a photoreceptor composed of a polymer complex with a charge generation function and a charge transport function.

<Protective Layer>

The protective layer according to the present invention protects the surface of the photoreceptor, improves low wear and scratch resistance, reduces the occurrence of toner slipping, and contributes to extending the life of the photoreceptor and thus the electrophotographic image forming apparatus. The thickness of the protective layer is preferably in the range of 0.2 to 10 μm, more preferably in the range of 0.5 to 6 μm. Within this range, the effect of extending the life of the photoreceptor is excellent, and the generation of transfer memory may be further reduced.

The protective layer according to the present invention contains at least a cured resin obtained by curing a polymerizable compound. Further, it is preferable that the protective layer contains at least inorganic fine particles from the viewpoint of improving the mechanical strength of the protective layer of the photoreceptor and contributing to a long life.

(Cured Resin)

The cured resin is a main component constituting the protective layer. In the protective layer, since this cured resin is a main component, it is basically possible to obtain high film strength. The cured resin is obtained by polymerizing a compound having two or more radical polymerizable functional groups (hereinafter also referred to as "polyfunctional radical polymerizable compound"). Specifically, the cured resin is formed by polymerizing and curing a polyfunctional radical polymerizable compound by irradiation with active rays such as ultraviolet rays and electron beams.

As the polymerizable compound (monomer) for forming the cured resin, a polyfunctional radical polymerizable compound is used. A compound having one radical polymerizable functional group (hereinafter also referred to as "monofunctional radical polymerizable compound") may be used in combination. When a monofunctional radical polymerizable compound is used, a content thereof is preferably 20 mass % or less to the total amount of the monomer for forming a binder resin. Examples of a radical polymerizable functional group include: a vinyl group, an acryloyl group, and a methacryloyl group.

As a polyfunctional radical polymerizable compound, it is particularly preferable to use an acryl type monomer or an oligomer having two or more acryloyl groups ($CH_2{=}CHCO{-}$), or methacryloyl groups ($CH_2{=}CCH_3CO{-}$). Consequently, the cured resin is preferably a (meth)acryl type resin formed with a (meth)acryl type monomer or a (meth)acryl type oligomer.

In the present invention, the polyfunctional radically polymerizable compound may be used alone or in combination. In addition, these polyfunctional radical polymerizable compounds may use monomers, but may be used after oligomerization. Hereinafter, specific examples of the polyfunctional radically polymerizable compound are indicated.

M1

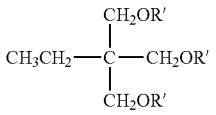

-continued

M2

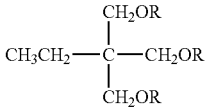

M3

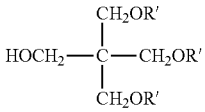

M4

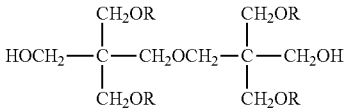

M5

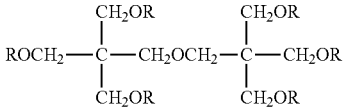

M6

$CH_3CH_2C(CH_2OC_3H_6OR)_3$

M7

$CH_3CH_2C(CH_2CH_2OR)_3$

M8

$R(OC_3H_6)_3OR$

M9

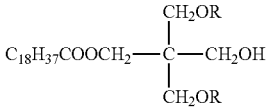

M10

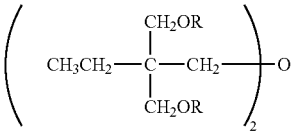

M11

$(ROCH_2)_4C$

M12

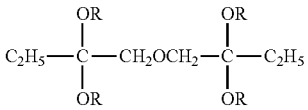

M13

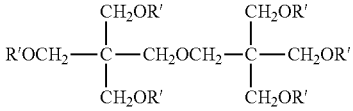

M14

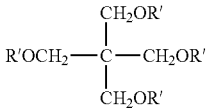

In the chemical formulas indicating the above exemplary compounds (M1) to (M14), R represents an aciyloyl group ($CH_2{=}CHCO{-}$), and R' represents a methaciyloyl group ($CH_2{=}CCH_3CO{-}$).

(Inorganic Fine Particles)

The protective layer according to the present invention preferably contains inorganic fine particles. The inorganic fine particles contribute to the improvement of the film strength of the protective layer and the image quality stability by adjusting the resistance. The number average particle diameter of the inorganic fine particles is preferably in the range of 0.1 to 0.5 μm. When it is 0.1 μm or more, sufficient strength of the photoreceptor can be obtained, and when it is 0.5 μm or less, light transmission is not hindered and occurrence of image unevenness may be prevented. The number average particle diameter of the inorganic fine particles may be measured as follows. Using a scanning electron microscope (SEM) "JSM-7401F" (manufactured by JEOL Ltd.), a SEM photograph magnified 10,000 times is taken with a scanner. With the image processing analyzer "LUZEX AP" (manufactured by Nireco), the inorganic fine particles in the SEM photograph image are binarized avoiding aggregated particles, the ferret diameter in the horizontal direction for 100 particles is calculated, and the average value is defined as the number average particle diameter.

Examples of the inorganic fine particles include silica (silicon oxide), magnesium oxide, zinc oxide, lead oxide, alumina (aluminum oxide), zirconium oxide, tin oxide, titania (titanium oxide), niobium oxide, molybdenum oxide, and vanadium oxide. Among these, it is preferable to use alumina because it has high hardness and increases the strength of the photoreceptor. The inorganic fine particles according to the present invention are not particularly limited, and particles produced by a known production method may be used. In addition, the inorganic fine particles may be a composite particle having a core-shell structure composed of an insulating particle (core) and a supported body (shell) made of a conductive metal oxide and supported on the surface of the insulating particle.

The inorganic fine particles may be surface-modified with a surface modifier having a reactive organic group (hereinafter also referred to as "reactive organic group-containing surface modifier"). The reactive organic group-containing surface modifier is preferably one that reacts with the hydroxy groups present on the surface of the inorganic fine particles. Examples of such reactive organic group-containing surface modifiers include silane coupling agents and titanium coupling agents. Moreover, as a reactive organic group containing surface modifier, the surface modifier which has a radically polymerizable reactive group is preferable. Examples of the radical polymerizable reactive group include a vinyl group, an acryloyl group, and a methacryloyl group. Such a radical polymerizable reactive group can react with a polymerizable compound to form a strong protective layer. As the surface modifier having a radically polymerizable reactive group, a silane coupling agent having a radically polymerizable reactive group such as a vinyl group, an acryloyl group, or a methacryloyl group is preferable.

The reactive organic group-containing surface modifier is preferably a silane coupling agent having a radical polymerizable group described above, and examples thereof include the following compounds S-1 to S-31.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$

S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$

As the reactive organic group-containing surface modifier, other than the compounds indicated in the exemplary compounds (S-1) to (S-31), a silane compound having a reactive organic group capable of radical polymerization may be used. These surface modifiers may be used alone or in combination. The treatment amount (addition amount) of the reactive organic group-containing surface modifier is preferably in the range of 0.1 to 200 mass parts, more preferably in the range of 7 to 70 mass parts with respect to 100 mass parts of the particles.

The treatment method of the reactive organic group-containing surface modifier for the untreated inorganic fine particles is not particularly limited. For example, a method of wet crushing a slurry (a suspension of solid particles) containing untreated inorganic fine particles and a reactive organic group-containing surface modifier may be used.

Examples of the surface modification device include a wet media disperser. This wet media disperser is a device operates as follows: a container of the device is filled with beads as dispersion media, and a stirring disk attached vertical to the rotary shaft is rotated at a high speed to pulverize and disperse aggregates of the untreated inorganic fine particles. The wet media disperser may have any configuration as long as it enables to perform sufficient dispersion of the untreated inorganic fine particles and surface treatment of the untreated inorganic fine particles during the surface treatment of the untreated inorganic fine particles. For example, usable wet media dispersers may be of a variety of types, such as vertical, horizontal, continuous, and batch types. Specific examples of the usable wet media disperser include: a sand mill, an Ultra-Visco mill, a pearl mill, a grain mill, a Dyno mill, an agitator mill, and a dynamic mill. These dispersion devices pulverize and disperse particles by impact pressure, friction, shear, and shear stress of grinding media, such as balls and beads.

Examples of beads used in the wet media disperser include balls composed of glass, alumina, zircon, zirconia, steel, and flint. Particularly preferred are zirconia and zircon beads. Although beads having a diameter of about 1 to 2 mm are usually used, those having a diameter of about 0.1 to 1.0 mm are preferably used in the present invention. Although the wet media disperser may include the disk and the inner wall of the container composed of a variety of materials, such as stainless steel, nylon, and ceramics, particularly preferred materials for the disk and the inner wall of the container in the present invention are ceramics, such as zirconia or silicon carbide. These inorganic fine particles may be used alone or in combination of two or more types.

The content of the inorganic fine particles is not particularly limited, but it is preferably in the range of 1 to 20 mass % with respect to the cured resin constituting the protective layer. When the content is 1 mass % or more, sufficient strength is obtained, and when the content is 20 mass % or less, light transmission is not hindered and unevenness does not occur in an image.

Further, the surface of the protective layer according to the present invention may be smooth, but more preferably has irregularities. When there are irregularities, the contact area between the toner and the photoreceptor becomes small, so that the toner is easily cleaned. The unevenness on the surface may be caused by the shape of the inorganic fine particles.

(Charge Transport Material)

The protective layer according to the present invention preferably contains a charge transport material. The charge transport material is a material having charge transport properties for transporting charge carriers in the protective layer, and is a material capable of adjusting the electrical resistance of the protective layer. Examples thereof include: amine compounds such as an N,N-dialkylaniline compound, a diarylamine compound and a triarylamine compound; and a pyrazoline compound, a carbazole compound, an imidazole compound, a triazole compound, an oxazole compound, a styryl compound, and a stilbene compound.

The charge transport material may be appropriately selected from known compounds, but the protective layer preferably contains a charge transport material having a structure represented, for example, by the following Formula (1) from the viewpoint of scratch resistance, charge injection characteristics, and low occurrence probability of transfer memory.

Formula (1)

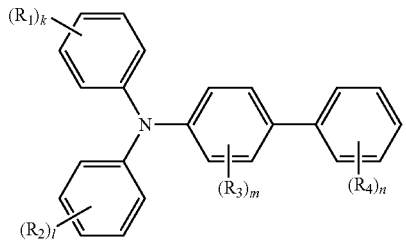

In the above-described Formula (1), $R_1$, $R_2$, $R_3$ and $R_4$ each independently represent an alkyl group having 1 to 7 carbon atoms, or an alkoxy group having 1 to 7 carbon atoms. k, 1, and n each independently represent an integer of 0 to 5. m represents an integer of 0 to 4. When k, 1, m and n represent an integer of 2 or more, a plurality of groups of $R_1$, $R_2$, $R_3$ and $R_4$ may be the same or different. Among these, $R_1$, $R_2$, $R_3$ and $R_4$ are preferably each independently an alkyl group having 1 to 3 carbon atoms. Further, k, 1, n and m are preferably each independently an integer of 0 or 1. An example of a preferred compound is CTM-1 used in the examples. As the compound represented by Formula (1), for example, those described in JP-A 2015-114454 may be used. Further, it may be synthesized by a known synthesis method, for example, a method disclosed in JP-A 2006-143720. These charge transport materials may be used alone or in combination of two or more.

The addition amount of the charge transport material is in the range of 1 to 25 mass parts, more preferably in the range of 5 to 20 mass parts, with respect to 100 mass parts of the polymerizable compound for constituting the cured resin component. Within the above range, the electrical characteristics become improved, and the life of the photoreceptor and thus the electrophotographic image forming apparatus, the effect of suppressing the transfer memory, and the effect of reducing the occurrence frequency of toner slipping are further improved.

(Specific Radical Scavenger)

The protective layer may contain a radical scavenger having a structure represented by the following Formula (2). The above polymerizable compound may be polymerized in the presence of a specific radical scavenger represented by Formula (2). This particular radical scavenger functions as a cross-linking sealant. That is, the specific radical scavenger may adjust a crosslinking density by the addition ratio. Therefore, the cured resin component is obtained by polymerizing a polymerizable compound in the presence of the specific radical scavenger, so that the protective layer has an appropriate film strength (abrasion resistance). The surface of the photoreceptor is moderately worn by a cleaning means such as a cleaning blade. Therefore, even if discharge products adhere to the surface of the photoreceptor, the surface of the photoreceptor is depleted and refreshed, so that image flow in the formed image may be prevented.

Formula (2)

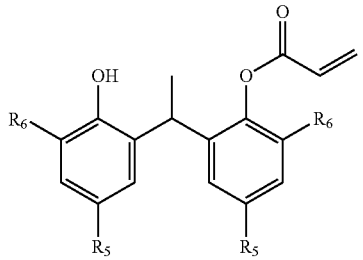

In the above-described Formula (2), $R_5$ and $R_6$ each independently represent an alkyl group having 1 to 6 carbon atoms. When $R_5$ and $R_6$ are alkyl groups having 1 to 6 carbon atoms, the influence of the steric hindrance of the radical scavenger may be reduced, and the crosslinking reaction may be easily controlled. $R_5$ and $R_6$ are each independently preferably an alkyl group having 4 or 5 carbon atoms from the viewpoint of the stability of the captured radical.

$R_5$ and $R_6$ are each independently preferably a tert-butyl group or a tert-pentyl group, more preferably a tert-pentyl group. These specific radical scavengers may be used alone or in combination of two or more.

As the specific radical scavenger, a synthetic product or a commercially available product may be used. Examples of the commercially available product include SUMILIZER™ GS manufactured by Sumitomo Chemical Co., Ltd. The addition amount of the specific radical scavenger is not particularly limited, but it is preferably 1 to 30 mass parts, and more preferably 2 to 15 with respect to 100 mass parts of the polymerizable compound for constituting the cured resin component. Within the above range, the effect of prolonging the life of the photoreceptor and thus the electrophotographic image forming apparatus, and reducing the occurrence frequency of toner slipping are further improved. In addition, an image flow suppression effect in the formed image can be obtained.

(Polymerization Initiator)

The polymerizable compound for constituting the cured resin component is preferably polymerized using a polymerization initiator. A radical polymerization initiator is preferably used as the polymerization initiator. The radical polymerization initiator is not particularly limited, but a photopolymerization initiator is preferable. Of these, an acylphosphine oxide compound, an alkylphenone compound, an oxime ester compound, and a thioxanthone compound are more preferred, and an acylphosphine oxide compound and an oxime ester compound are more preferred. These polymerization initiators may be used alone or in combination of two or more.

Although the acyl phosphine oxide compound is not limited in particular, the following compounds may be preferably used, for example.

(P1)

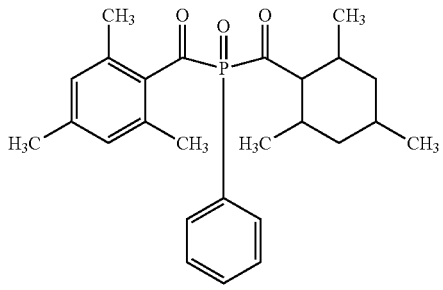

(P2)

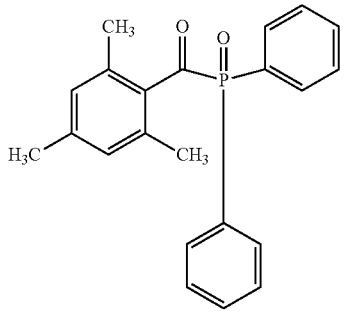

Although the oxime ester compound is not limited in particular, the following compounds may be preferably used for example.

(P3)

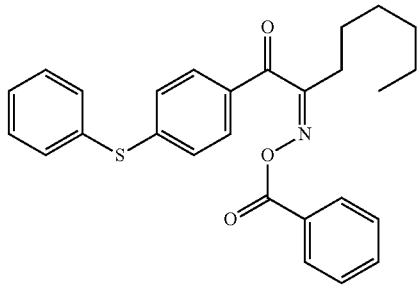

(P4)

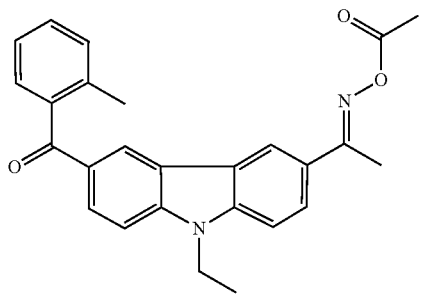

These polymerization initiators may be used alone or in combination of two or more. A content of the polymerization initiator is preferably in the range of 0.1 to 20 mass parts, more preferably in the range of 0.5 to 10 mass parts with respect to the total 100 mass parts of the polymerizable monomer. Within the above range, the life of the photoreceptor, and thus the electrophotographic image forming apparatus, the effect of suppressing the transfer memory in the formed image, and the effect of reducing the occurrence frequency of toner slipping are further improved.

(Other Components)

The protective layer may further contain other components. For example, an antioxidant and lubricant may be contained. The antioxidant is not particularly limited, but for example, those described in JP-A-2000-305291 may be preferably used.

Although the lubricant particles are not limited in particular, fluorine-atom containing resin particles may be added. Examples of the fluorine atom-containing resin particles include: a tetrafluoroethylene resin, a trifluorochloroethylene resin, a hexafluorochloroethylene-propylene resin, a vinyl fluoride rein, a vinylidene fluoride resin, a difluorodichloroethylene resin, and copolymers of these resins. These polymers may be used alone or in combination. Among these resins, particularly preferred are a tetrafluoroethylene resin and a vinylidene fluoride resin.

Hereinafter, the configuration of the photoreceptor other than the protective layer will be described in the case of the layer configuration (1) described above.

<Conductive Support>

The conductive support according to the present invention may be composed of any material having conductivity. Examples of the material include: a drum or a sheet formed with a metal such as aluminum, copper, chromium, nickel, zinc, or stainless steel, formed in a drum or a sheet; a laminate of a plastic film and a metal foil of aluminum or copper; a plastic film on which aluminum, indium oxide, or tin oxide is deposited; and a metal, a plastic film, and paper having a conductive layer disposed thereon through application of a single conductive substance or a combination thereof with a binder resin.

<Intermediate Layer>

In the electrophotographic photoreceptor according to the present invention, an intermediate layer that functions as a barrier may be formed between the conductive support and the photosensitive layer. Such an intermediate layer is preferably disposed to prevent a variety of failures.

Such an intermediate layer contains a binder resin (hereinafter, also referred to as "a binder resin for an intermediate layer"), and optional conductive particles or metal oxide particles, for example.

Examples of the binder resin for an intermediate layer include casein, poly(vinyl alcohol), nitrocellulose, ethylene-acrylic copolymers, polyamide resins, polyurethane resins, and gelatin. Among these resins, preferred are alcohol-soluble polyamide resins.

The intermediate layer may contain a variety of conductive particles or metal oxide particles to have suitable resistance. A variety of metal oxide particles, such as alumina, zinc oxide, titanium oxide, tin oxide, antimony oxide, indium oxide, and bismuth oxide particles may be used. Ultrafine particles of tin-doped indium oxide and antimony-doped tin oxide and zirconium oxide may also be used. These metal oxide particles have a number average primary particle size of preferably 0.3 μm or less, more preferably 0.1 μm or less.

These metal oxide particles may be used alone or in combination. A combination of these metal oxide particles may be in the form of a solid solution or a fused product.

The content of the conductive particles or the metal oxide particles is preferably in the range of 20 to 400 mass parts, more preferably in the range of 50 to 350 mass parts with respect to 100 mass parts of the binder resin.

The thickness of the intermediate layer is preferably in the range of 0.1 to 15 μm, more preferably in the range of 0.3 to 10 μm.

<Charge Generating Layer>

The charge generating layer according to the present invention includes a charge generating material and a binder resin (hereinafter, also referred to as "a binder resin for a charge generating layer").

Examples of the charge generating material include, but should not be limited to: azo pigments such as Sudan red and Dian blue; quinone pigments such as pyrenequinone and anthanthrone; quinocyanine pigments; peiylene pigments; indigo pigments such as indigo and thioindigo; polycyclic quinone pigments such as pyranthrone and diphthaloylpyrene; and phthalocyanine pigments. Among these charge generating materials, preferred are polycyclic quinone pigments and titanyl phthalocyanine pigments. These charge generating materials may be used alone or in combination of two or more kinds.

Any known resins may be used as the binder resin for a charge generating layer. Examples of such a resin include, but should not be limited to: polystyrene, polyethylene, polypropylene, acrylic, methacrylic, poly(vinyl chloride), poly(vinyl acetate), poly(vinyl butyral), epoxy, polyurethane, phenol, polyester, alkyd, polycarbonate, silicone, and melamine resins, copolymer resins containing two or more of these resins (such as vinyl chloride-vinyl acetate copolymer resins and vinyl chloride-vinyl acetate-maleic anhydride copolymer resins), and poly(vinyl carbazole) resins. Among these resins, preferred are poly(vinyl butyral) resins.

The content of the charge generating material in the charge generating layer is preferably in the range of 1 to 600 mass parts, more preferably in the range of 50 to 500 mass parts with respect to 100 mass parts of the binder resin for a charge generating layer.

Although the thickness of the charge generating layer is varied according to the characteristics of the charge generating material, those of the binder resin for a charge generating layer, and the contents thereof, the thickness is preferably in the range of 0.01 to 5 μm, more preferably in the range of 0.05 to 3 μm.

<Charge Transport Layer>

The charge transport layer includes a charge transport material and a binder resin (hereinafter, also referred to as "a binder resin for a charge transport layer").

Examples of the charge transport material contained in the charge transport layer include triphenylamine derivatives, hydrazone compounds, styryl compounds, benzidine compounds, and butadiene compounds.

Any known resins may be used as the binder resin for a charge transport layer. Examples of such a known resin include polycarbonate resins, polyacrylate resins, polyester resins, polystyrene resins, styrene-acrylonitrile copolymer resins, polymethacrylate resins, and styrene-methacrylate copolymer resins. Preferred are polycarbonate resins. Also preferred are polycarbonate resins of a bisphenol A (BPA) type, a bisphenol Z (BPZ) type, a dimethyl BPA type, and a BPA-dimethyl BPA copolymer type in view of crack resistance, abrasion resistance, and charging characteristics.

The content of the charge transport material in the charge transport layer is preferably in the range of 10 to 500 mass parts, more preferably in the range of 20 to 250 mass parts with respect to 100 mass parts of the binder resin for a charge transport layer.

Although the thickness of the charge transport layer is varied according to the characteristics of the charge transport material, those of the binder resin for a charge transport layer, and the contents thereof, the thickness is preferably in the range of 5 to 40 μm, more preferably in the range of 10 to 30 μm.

The charge transport layer may contain an antioxidant, an electron conductive agent, a stabilizer, and silicone oil. Preferred antioxidants are those disclosed in JP-A 2000-305291, and preferred electron conductive agents are those disclosed in JP-A 50-137543, and JP-A 58-76483.

[Production Method of Photoreceptor]

An example of the production method of electrophotographic photoreceptor of the present invention contains the following steps.

Step (1): a step of forming an intermediate layer by applying a coating liquid for forming an intermediate layer to an outer peripheral surface of a conductive support, followed by drying the intermediate layer.

Step (2): a step of forming a charge generating layer by applying a coating liquid for forming a charge generating layer to an outer peripheral surface of the intermediate layer formed on the conductive support, followed by drying the charge generating layer.

Step (3): a step of forming a charge transport layer by applying a coating liquid for forming a charge transport layer to an outer peripheral surface of the charge generating layer formed on the intermediate layer, followed by drying the charge transport layer.

Step (4): a step of forming a protective layer by applying a coating liquid for forming a protective layer to an outer peripheral surface of the charge transport layer formed on the charge generating layer, followed by irradiating with UV rays to cure the protective layer.

<Step (1): Formation of Intermediate Layer>

The intermediate layer may be formed with the following method, for example. A binder resin for an intermediate layer is dissolved in a solvent to prepare a coating liquid (hereafter, it may be called as "a coating liquid for forming an intermediate layer"). Subsequently, according to necessity, conductive particles or metal oxide particles are dispersed in this liquid. This coating liquid is applied on a conductive support with a predetermined thickness to obtain a coated layer. The intermediate layer may be formed by drying this coated layer.

As a dispersing method for dispersing conductive particles or metal oxide particles into a coating liquid for forming an intermediate layer, it may be cited: an ultrasonic disperser, a ball mill, a sand mill, and a homo mixer. However, the dispersing method is not limited to these. As a coating method of a coating liquid for forming an intermediate layer, it may be cited known methods such as: a dip coating method, a spray coating method, a spinner coating method, a bead coating method, a blade coating method, a beam coating method, a slide hopper method, and a circular slide hopper method. A drying method of the coated layer may be suitably selected from the known drying methods according to the kinds of solvent and the thickness of the layer. A heat drying method is preferably used.

As a solvent used for forming an intermediate layer, it is sufficient that it will dissolve the binder resin for the intermediate layer, and it will give a good dispersion property for the conductive particles or the metal oxide particles. Examples of a preferable solvent are alcohols with 1 to 4 carbon atoms such as: methanol, ethanol, n-propyl alcohol, isopropyl alcohol, n-butanol, t-butanol, and sec-butanol. These are preferably used from the viewpoint of solubility of the binder resin and coating property. In order to increase the storage stability and the dispersion property of the particles, it may be used an auxiliary solvent. Examples of an auxiliary solvent which may be used with the above-described solvent and may give a good effect are: benzyl alcohol, toluene, dichloromethane, cyclohexanone, and tetrahydrofuran.

A content of the binder resin for an intermediate layer in the coating liquid for forming an intermediate layer may be suitably selected in accordance with the layer thickness of the intermediate layer and the production speed.

<Step (2): Formation of Charge Generating Layer>

The charge generating layer may be formed with the following method, for example. A charge generating material is dispersed into a solution of a binder resin for a charge generating layer dissolved in a solvent to obtain a coating liquid (hereafter, it may be called as "a coating liquid for forming a charge generating layer"). This coating liquid is applied on the intermediate layer with a predetermined thickness to obtain a coated layer. The charge generating layer may be formed by drying this coated layer.

As a dispersing method for dispersing charge generating material into a coating liquid for forming a charge generating layer, it may be cited: an ultrasonic disperser, a ball mill, a sand mill, and a homo mixer. However, the dispersing method is not limited to these. As a coating method of a coating liquid for forming a charge generating layer, it may be cited known methods such as: a dip coating method, a spray coating method, a spinner coating method, a bead coating method, a blade coating method, a beam coating method, and a slide hopper method. A drying method of the coated layer may be suitably selected from the known drying methods according to the kinds of solvent and the thickness of the layer. A heat drying method is preferably used.

Examples of a solvent used for formation of the charge generating layer include: toluene, xylene, dichloromethane, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1,4-dioxane, 1,3-dioxolane, pyridine, and diethylamine. The solvent is not limited to them.

<Step (3): Formation of Charge Transport Layer>

The charge transport layer may be formed with the following method, for example. A binder resin for a charge transport layer and a charge transport material are dissolved in a solvent to obtain a coating liquid (hereafter, it may be called as "a coating liquid for forming a charge transport layer"). This coating liquid is applied on the charge generating layer with a predetermined thickness to obtain a coated layer. The charge transport layer may be formed by drying this coated layer.

As a coating method of a coating liquid for forming a charge transport layer, it may be cited known methods such as: a dip coating method, a spray coating method, a spinner coating method, a bead coating method, a blade coating method, a beam coating method, a slide hopper method, and a circular slide hopper method. A drying method of the coated layer may be suitably selected from the known drying methods according to the kinds of solvent and the thickness of the layer. A heat drying method is preferably used.

Examples of a solvent used for formation of the charge transport layer include: toluene, xylene, dichloromethane, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine, and diethylamine. The solvent is not limited to them.

<Step (4): Formation of Protective Layer>

The protective layer of the present invention may be formed as follows. A polyfunctional radical polymerizable compound, inorganic fine particles, a polymerization initiator and other components as required are added to a known solvent to prepare a coating liquid (hereinafter also referred to as "coating liquid for forming a protective layer"). The coating solution for forming the protective layer is applied to the outer peripheral surface of the charge transport layer formed in the step (3) to form a coating film. The protective layer may be formed by drying this coating film and polymerizing the radically polymerizable compound component in the coating film by irradiating active rays such as ultraviolet rays and electron beams.

When the protective layer is formed by a reaction between polyfunctional radical polymerizable compounds, or when the inorganic fine particles are surface-treated with a surface treatment agent comprising a compound having a radical polymerizable functional group, a cross-linked cured resin is formed by the reaction of the radical polymerizable functional group of the surface treatment agent with the radical polymerizable functional group of the polyfunctional radical polymerizable compound.

As a dispersing method for dispersing the inorganic fine particles into a coating liquid for forming protective layer, it may be cited: an ultrasonic disperser, a ball mill, a sand mill, and a homo mixer. However, the dispersing method is not limited to these.

As the solvent used for forming the protective layer, any solvent may be used as long as it may dissolve or disperse the polyfunctional radical polymerizable compound and inorganic fine particles. Examples thereof include: methanol, ethanol, n-propyl alcohol, isopropyl alcohol, n-butanol, t-butanol, and sec-butanol, benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, and diethylamine. The solvent is not limited to them.

As a coating method of a coating liquid for forming a protective layer, it may be cited known methods such as: a dip coating method, a spray coating method, a spinner coating method, a bead coating method, a blade coating method, a beam coating method, a slide hopper method, and a circular slide hopper method. The coating liquid for forming the protective layer is preferably applied using a circular slide hopper coating apparatus.

Although a curing treatment may be performed to the coated layer formed with the coating liquid for forming a protective layer without drying, it is preferable that a curing treatment is performed to the coated layer after subjecting it to natural drying or heat drying. The drying conditions of the coated layer are suitably selected depending on the kind of solvent used in the coating liquid or the thickness of the coated layer. The drying temperature is preferably in the range of room temperature to 180° C., more preferably, it is in the range of 80 to 140° C. The drying time is preferably 1 to 200 minutes, more preferably, it is 5 to 100 minutes.

Examples of the method of polymerizing a radical polymerizable compound include a method of reacting by electron beam cleavage, a method of adding a radical polymerization initiator and reacting with light and heat. As the radical polymerization initiator, any of the above-described photopolymerization initiator and thermal polymerization initiator may be used. Moreover, a photo polymerization initiator and a thermal polymerization initiator may also be used together.

A cured resin is produced by irradiating an active ray to a coating film as a hardening process with generating a radical to perform polymerizing, and forming the cross-linking by a cross-linking reaction between molecules and within a molecule to result in hardening. As the actinic radiation, ultraviolet rays and electron beams are more preferred, and ultraviolet rays are particularly preferred because they are easy to use.

Any light source may be used as a UV ray source as long as it generates UV rays. Examples of a UV source include: a low-pressure mercury lamp, a middle-pressure mercury lamp, a high-pressure mercury lamp, an ultrahigh-pressure mercury lamp, a carbon-arc lamp, a metal halide lamp, a xenon lamp, and a flash (pulsed) xenon lamp. The conditions of emitting light may vary depending on the type of the lamp. The dose of UV rays is usually in the range of 5 to 500 $mJ/cm^2$, preferably it is in the range of 5 to 100 $mJ/cm^2$. The output power of the light source is preferably in the range of 0.1 to 5 kW, particularly preferably, it is in the range of 0.5 to 3 kW.

As an electron beam source, there is no particular limitation on the electron beam irradiation apparatus. Generally, as an electron beam accelerator for such electron beam irradiation, a curtain beam type that is relatively inexpensive and capable of providing a large output is effectively used. The acceleration voltage at the time of electron beam irradiation is preferably in the range of 100 to 300 kV. The absorbed dose is preferably in the range of 0.5 to 10 Mrad.

The irradiation time for obtaining the necessary irradiation amount of active rays is preferably from 0.1 second to 10 minutes, and more preferably from 0.1 second to 5 minutes from the viewpoint of work efficiency.

In the step of forming the surface layer, drying can be performed before and after irradiation with active rays and during irradiation with active rays, and the timing of drying can be appropriately selected by combining these.

[Electrophotographic Image Forming Apparatus]

The electrophotographic image forming apparatus (hereinafter also simply referred to as "image forming apparatus") used in the image forming method of the present invention includes the above-described electrophotographic photoreceptor, a charging unit, an exposure unit, a developing unit, a transfer unit, and a cleaning unit. The image forming apparatus further includes a unit for supplying a lubricant, and the unit for supplying the lubricant supplies the fine powdery lubricant externally added to the electrostatic image developing toner in the developing means. The electrophotographic photoreceptor is preferably supplied by the action of the developing electric field formed. Moreover, it is preferable that zinc stearate is contained as the lubricant.

The charging unit is preferably a proximity charging unit such as a charging roller, a charging brush, a charging belt, or a charging blade. When such a charging unit is used, the surface of the photoconductor tends to be greatly deteriorated, so that the effect of the present invention may be obtained more significantly. Among these, from the viewpoint of charging stability, it is preferable to use a charging roller as the charging unit.

Hereinafter, an image forming apparatus according to an embodiment of the present invention will be described with reference to the accompanying drawings. However, the present invention is not limited to only one form described below. The FIGURE is a schematic cross-sectional view illustrating a structure of a tandem type electrophotographic image forming apparatus according to an embodiment of the present invention. The above-described image forming apparatus is called as a tandem color image forming apparatus, and it includes four image-forming units 10Y, 10M, 10C, and 10K, an intermediate transferring unit 70, a sheet feeding unit 21, and a fixing unit 24. The image forming apparatus further includes a document scanner SC above a body A of the electrophotographic image forming apparatus.

The four image forming units 10Y, 10M, 10C, and 10K each respectively include: the photoreceptors 1Y, 1M, 1C, and 1K at the center, the charging units 2Y, 2M, 2C, and 2K, the exposure units 3Y, 3M, 3C, and 3K, the developing units 4Y, 4M, 4C, and 4K, and the cleaning units 6Y, 6M, 6C, and 6K for cleaning the photoreceptors 1Y, 1M, 1C, and 1K located around the photoreceptors. The electrophotographic image forming apparatus according to one embodiment of the present invention uses the above-described photoreceptor of the present invention as the photoreceptors 1Y, 1M, 1C, and 1K.

The image forming units 10Y, 10M, 10C, and 10K have the same configuration except for the colors (yellow, magenta, cyan and black) of toner images provided for the photoreceptors 1Y, 1M, 1C, and 1K. Therefore, the image forming unit 10Y will be described in detail below as an example. The image forming unit 10Y includes a charging unit 2Y, an exposure unit 3Y, a developing unit 4Y, and a cleaning unit 6Y around a photoreceptor 1Y that is an image forming body. A yellow (Y) toner image is formed on the photoreceptor 1Y.

The charging unit 2Y is a unit that uniformly charges the surface of the photoreceptor 1Y to a negative polarity. In the electrophotographic image forming apparatus of this embodiment, it is preferable to use a charging roller as the charging unit 2Y. The charging roller is disposed close to the photoreceptor, and charges the photoreceptor to a desired polarity and potential by applying a voltage of about −2.5 to −1.5 kV to the charging roller, for example. As a voltage to be applied to the charging roller, a DC charging method in which only a DC electric field is applied to charge the photoreceptor, and an AC in which an AC electric field is superimposed on the DC electric field is applied to a charging member to charge the photoreceptor may be used. The AC charging method that may produce a smoothing effect by an AC electric field is preferable because of excellent charging uniformity.

In the AC charging method, as the voltage applied to the charging roller, a DC electric field or an AC electric field may be selected among a DC constant voltage, a DC constant current, an AC constant voltage, and an AC constant current.

The exposure unit 3Y is a unit that performs exposure based on an image signal (yellow) on the photoreceptor 1Y to which a uniform potential is applied by the charging unit 2Y, and forms an electrostatic latent image corresponding to a yellow image. As the exposure unit 3Y, for example, a device composed of an LED having light emitting elements arranged in an array in the axial direction of the photoreceptor 1Y and an imaging element, or a laser optical system is used.

The developing unit 4Y includes, for example, a developing sleeve (not illustrated) that contains a magnet and rotates while holding the developer, and a voltage applying device that applies a DC and/or AC bias voltage between the photoreceptor and the developing sleeve. The developing unit 4Y contains a Y component developer (for example, a two component developer containing a toner and a magnetic carrier as main components). The developing unit 4Y visualizes the electrostatic latent image and forms a toner image by attaching the Y component toner to the surface of the photoreceptor 1Y. Specifically, a developing bias is applied to the developing sleeve, and a developing electric field is formed between the photoreceptor 1Y and the developing sleeve. Due to the potential difference between the photoreceptor 1Y (negative polarity) and the developing sleeve, the charged toner (negative polarity) on the developing sleeve moves to and adheres to the exposed portion of the surface of the photoreceptor 1Y. That is, the developing unit 4Y develops the electrostatic latent image by the reverse development method.

The cleaning unit 6Y is a unit that removes the toner remaining on the surface of the photoreceptor 1Y. The cleaning unit 6Y of the present embodiment includes a cleaning blade. The cleaning blade includes a support member (not illustrated) and a blade member supported on the support member via an adhesive layer (not illustrated). The blade member is disposed in a state where the tip thereof faces in the direction (counter direction) opposite to the rotation direction of the photoreceptor 1Y at the contact portion with the surface of the photoreceptor 1Y.

In the electrophotographic image forming apparatus illustrated in the FIGURE, in the image forming unit 10Y, a photoreceptor 1Y, a charging unit 2Y, a developing unit 4Y, a lubricant supply unit (not illustrated) and a cleaning unit 6Y described later are integrally supported to form a process cartridge. This process cartridge may be configured to be detachable from the apparatus main body A via guide means such as a rail.

The image forming units 10Y, 10M, 10C, and 10K are aligned in the vertical direction. The intermediate transferring unit 70 is disposed on the left of the photoreceptors 1Y, 1M, 1C, and 1K in the FIGURE. The intermediate transfer unit 70 is composed of: a semiconductive endless belt-like intermediate transfer member 77 wound around via a plurality of rollers 71, 72, 73, and 74, and is rotatably supported; a second secondary transfer roller 5*b* as a secondary transfer means; and a cleaning unit 6*b*. The image forming units 10Y, 10M, 10C, and 10K, and the intermediate transferring unit 70 are accommodated in a housing 80. The housing 80 has a structure which can be drawn from the apparatus body A via rails 82L and 82R.

As a fixing unit 24, it may be cited a heat-roller type fixing device composed of: a heat roller incorporating a heat source inside thereof; and a pressure roller which forms a nip portion at the heat roller in such a manner to abut the heat roller. In the FIGURE, 20 is a paper feed cassette, 22A, 22B, 22C and 22D are intermediate rollers, 23 is a registration roller, 25 is a paper discharge roller, 26 is a paper discharge tray, and P is a transfer material. In the FIGURE, the image forming apparatus of the present invention is shown as a color laser printer. However, the electrophotographic image forming apparatus according to one embodiment of the present invention may be configured as a copying machine. In the image forming apparatus according to one embodiment of the present invention, a light source other than a laser, for example, an LED light source may be used as the exposure light source.

In the FIGURE, an image forming apparatus having four image forming units corresponding to YMCK has been described as an example of a preferable image forming apparatus of the present invention. Another preferable example is an image forming apparatus further including an image forming unit corresponding to another color such as clear, white, gold, or silver.

<Lubricant Supply Unit>

The electrophotographic image forming apparatus according to an embodiment of the present invention preferably includes a lubricant supply unit for supplying a lubricant to the surface of the photoreceptor.

The type of the lubricant is not particularly limited and may be appropriately selected from known ones, but preferably contains a fatty acid metal salt. As the fatty acid metal salt, a metal salt of a saturated or unsaturated fatty acid having 10 or more carbon atoms is preferable. Examples thereof include zinc laurate, barium stearate, lead stearate, iron stearate, nickel stearate, cobalt stearate, copper stearate, strontium stearate, calcium stearate, cadmium stearate, magnesium stearate, zinc stearate, aluminum stearate, indium stearate, potassium stearate, lithium stearate, sodium stearate, zinc oleate, magnesium oleate, iron oleate, cobalt oleate, copper oleate, lead oleate, manganese oleate, aluminum oleate, zinc palmitate, cobalt palmitate, lead palmitate, magnesium palmitate, aluminum palmitate, calcium palmitate, lead caprate, zinc linolenate, cobalt linolenate, calcium linolenate, zinc ricinoleate, cadmium ricinoleate. Among these, zinc stearate is particularly preferable from the viewpoints of lubricity, spreadability, and hygroscopicity.

As the fatty acid metal salt, a synthetic product or a commercially available product may be used, and examples of the commercially available product include Zinc Stearate S manufactured by NOF Corporation. These fatty acid metal salts may be used alone or in combination of two or more.

The lubricant supply unit is not particularly limited, and examples thereof include units for supplying the lubricant by a method of applying a solid lubricant with a brush roller (hereinafter also referred to as "lubricant application unit").

When using the lubricant applying unit, for example, in the image forming unit 10Y of the image forming apparatus illustrated in the FIGURE, the lubricant applying unit is preferably disposed downstream of the cleaning unit 6Y and upstream of the charging unit 2Y in the rotational direction of the photoreceptor 1Y. However, the arrangement position of the lubricant application unit is not limited to the downstream side of the cleaning unit 6Y and the upstream side of the charging unit 2Y. The lubricant application unit is not particularly limited, but it is preferably constituted by, for example, a solid lubricant and a lubricant application member made of a brush roller. Specifically, the lubricant coating unit preferably has the following configuration. Ii is composed of: a lubricant stock composed of a solid lubricant having a rectangular parallelepiped shape; a brush roller that contacts the surface of the photoreceptor 1Y and applies the lubricant scraped off by rubbing the surface of the lubricant stock to the surface of the photoreceptor 1Y; a pressure spring that presses the lubricant stock against the brush roller; and a drive mechanism that rotates the brush roller. In the brush roller, the tip of the brush comes into contact with the surface of the photoreceptor 1Y. The brush roller is preferably driven to rotate at the same speed as the rotation direction of the photoreceptor 1Y. A leveling blade for uniformly applying the lubricant supplied to the surface of the photoreceptor 1Y by the lubricant applying unit may be provided on the downstream side of the lubricant applying unit and the upstream side of the charging unit 2Y. The lubricant application unit is not particularly limited, and known units may be appropriately referred to, for example, JP-A 2016-188950 may be referred to.

Further, the lubricant supply unit is not particularly limited, and the following methods may be mentioned. This method contains the step of supplying the fine powder lubricant externally added to the toner base particles to the photoreceptor (for example, 1Y in the FIGURE) by the action of the developing electric field formed in the developing unit (for example, 4Y in the FIGURE) (this method may be called as "toner-containing method"). That is, the toner-containing method is a method for supplying the fine powder lubricant contained in the toner to the photoreceptor by the action of a developing electric field formed in the developing unit. Since the toner-containing method does not involve an intermediate member such as a brush roller, unlike the above-mentioned lubricant application means, it is particularly preferable because there is no contamination of the lubricant and no variation in the amount of lubricant supplied due to contamination or deterioration of the intermediate member.

In the toner-containing method, a fine powder lubricant is externally added as an external additive to toner base particles described later. The volume-based median diameter Dw of the finely powdered lubricant is preferably in the range of 0.3 to 25 μm, and more preferably in the range of 0.5 to 20 μm. When the amount is within the above range, since the size of the lubricant is moderately small, the adhesion force with the toner mother particles becomes moderately large, and the occurrence of migration within the developing unit is less likely to occur, so that the supply of the lubricant will be more sufficient. Further, since the size of the lubricant is moderately large, the adhesion of the lubricant to the toner mother particles is moderately reduced, so that the lubricant may be easily transferred onto the photoreceptor. Thus, the lubricant may be uniformly supplied onto the photoreceptor. The volume-based median diameter Dw of the lubricant is obtained by measurement and calculation using a device in which a data processing computer system (Beckman Coulter Inc.) is connected to COULTER MULTISIZER 3 (Beckman Coulter Inc.). It is also possible to measure the particle size of the lubricant externally added to the toner mother particles (colored particles) by a known method such as electron microscopic photography. For the evaluation method of the volume-based median diameter Dw of the fine powder lubricant, the description in paragraphs "0031" and "0032" of JP-A 2010-175701 may be referred to. Details are described in the examples.

The addition amount of the fine powder lubricant is preferably in the range of 0.01 to 0.5 mass parts, and more preferably in the range of 0.03 to 0.3 mass parts with respect to the total mass of the toner. Within the above range, the effect of the present invention is more exhibited while suppressing the influence on the chargeability of the toner. The mixing method of the toner mother particles and the lubricant is not particularly limited, and a known method may be appropriately selected. For example, it may be performed using a HENSCHEL mixer (registered trademark) manufactured by Nippon Coke Industries, Ltd. As mentioned above, although the embodiment of the present invention was described specifically, the embodiment of the present invention is not limited to the described example, and a various change may be added.

EXAMPLES

Hereinafter, the present invention will be specifically described with reference to examples, but the present invention is not limited thereto. Unless otherwise specified, "%" and "part" mean "mass %" and "mass part", respectively.

[Production of Alumina Particles 1]

Alumina Particles were produced in conformity with the known burner device described in Example 1 of European Patent No. 0585544 with reference to the description in JP-A 2012-224542. Specifically, 320 kg/h of aluminum trichloride ($AlCl_3$) was evaporated in an evaporator at about 200°

C., and chloride vapor was passed through the mixing chamber of the burner with nitrogen. Here, the gas stream was mixed with 100 $Nm^3/h$ of hydrogen and 40 $Nm^3/h$ of air and fed to the flame via a central tube (diameter 7 mm). As a result, the burner temperature was 230° C., and the discharge speed of the tube was about 35.8 m/s. 0.05 $Nm^3/h$ of hydrogen was supplied as a jacket type gas through the outer tube. The gas was combusted in the reaction chamber and was cooled to about 110° C. in the downstream agglomeration zone. There, agglomeration of primary particles of alumina was performed. The resulting aluminum oxide particles were separated from the hydrochloric acid-containing gas produced in a filter or cyclone, and the adhesive chloride was removed by treating the powder with wet air at about 500 to 700° C. Thus, alumina particles 1 having a number average particle diameter of 20 nm were obtained.

[Production of Alumina Particles 2 to 9]

In the same manner as the preparation of the alumina particles 1, alumina particles 2 to 9 were prepared by adjusting various conditions so that the number average particle diameter described in Table I below was obtained. The particle size of the alumina particles was adjusted as a reaction condition by the flame temperature, the content of hydrogen or oxygen, the quality of aluminum trichloride, the residence time in the flame or the length of the agglomeration zone.

TABLE I

| Alumina particles No. | Number average particle diameter (nm) |
|---|---|
| 1 | 20 |
| 2 | 5.1 |
| 3 | 59 |
| 4 | 9 |
| 5 | 10 |
| 6 | 25 |
| 7 | 27 |
| 8 | 4 |
| 9 | 63 |

[Preparation of Silica Particles 1]

(1) 630 mass parts of methanol and 90 mass parts of water were added to and mixed with a 3 liter reactor equipped with a stirrer, a dropping funnel, and a thermometer. While stirring this solution, 1,145 mass parts of tetramethoxysilane was hydrolyzed to obtain a suspension of silica fine particles. Subsequently, the mixture was heated to 60 to 70° C., and 390 mass parts of methanol was distilled off to obtain an aqueous suspension of silica fine particles.

(2) Methyltrimethoxysilane (16.6 mass parts in this case) in a molar ratio of 0.1 to tetramethoxysilane was added dropwise to this aqueous suspension at room temperature to treat the surface of silica fine particles.

(3) After adding 1,400 mass parts of methyl isobutyl ketone to the dispersion thus obtained, the mixture was heated to 80° C. to distill off methanol water. To the obtained dispersion, 343 mass parts of hexamethyldisilazane was added at room temperature, heated to 120° C. and reacted for 3 hours to trimethylsilylate the silica fine particles. Thereafter, the solvent was distilled off under reduced pressure to prepare silica particles, whereby silica particles 1 having a number average particle diameter of 100 nm were obtained.

[Preparation of Silica Particles 2]

The silica particles 2 was prepared in the same manner as preparation of the silica particles 1 except that tetramethoxysilane was changed to 914 mass parts and hexamethyldisilazane was changed to 274 mass parts. Thus silica particles 2 having a number average particle diameter of 81 nm was obtained.

[Preparation of Silica Particles 3]

The silica particles 3 was prepared in the same manner as preparation of the silica particles 1 except that a 5 liter reactor was used, tetramethoxysilane was changed to 2,286 mass parts and hexamethyldisilazane was changed to 686 mass parts. Thus silica particles 3 having a number average particle diameter of 198 nm was obtained.

[Preparation of Silica Particles 4]

The silica particles 4 was prepared in the same manner as preparation of the silica particles 1 except that tetramethoxysilane was changed to 800 mass parts and hexamethyldisilazane was changed to 240 mass parts. Thus silica particles 4 having a number average particle diameter of 72 nm was obtained.

[Preparation of Silica Particles 5]

The silica particles 5 was prepared in the same manner as preparation of the silica particles 2 except that tetramethoxysilane was changed to 2,400 mass parts and hexamethyldisilazane was changed to 720 mass parts. Thus silica particles 5 having a number average particle diameter of 210 nm was obtained.

TABLE II

| Silica particles No. | Number average particle diameter (nm) |
|---|---|
| 1 | 100 |
| 2 | 81 |
| 3 | 198 |
| 4 | 72 |
| 5 | 210 |

[Preparation of Photoreceptor 1]

<Preparation of Conductive Support>

A conductive support was prepared through milling the surface of a cylindrical aluminum support.

<Formation of Intermediate Layer>

The following components were mixed in the following amounts. The mixture was subjected to a dispersion treatment of a batch method with a sand mill for 10 hours to obtain a coating liquid for forming an intermediate layer. The coating liquid for forming an intermediate layer was applied to a surface of the conductive support through dip coating. Subsequently, the coated layer was dried at 110° C. for 20 minutes to obtain an intermediate layer having a dry film thickness of 2 μm on the conductive support. "X 1010" (made by Daicel-Degussa Ltd.) was used as a polyamide resin. "SMT500SAS" (mad by TEIKA Co. Ltd.) was used as titanium oxide particles.

| | |
|---|---|
| Polyamide resin: | 10 mass parts |
| Titanium oxide particles: | 11 mass parts |
| Ethanol: | 200 mass parts |

<Formation of Charge Generation Layer>

A coating liquid for forming a charge generation layer was prepared through mixing of the following materials in the following amounts with a circulating ultrasonic homogenizer "RUS-600 TCVP" (made by Nissei Corporation). The dispersion was done under the conditions of 19.5 kHz, 600 W, circulating flow amount of 40 L/h for 0.5 hours. The above-described liquid for forming a charge generation layer was applied onto the intermediate layer through dip coating, and the resultant film was dried to form a charge generation layer having a thickness of 0.3 μm. As a charge generation material, the following was used: titanylphthalocyanine (having at least a maximum diffraction peak at 8.3°, 24.7°, 25.1°, and 26.5° as measured by Cu-Kα X-ray diffractometry) with (2R, 3R)-2,3-butandiol (1:1 aduct) and non-adduct of titanylphthalocyanine (mixed crystal). "S-LEC BL-1" (made by Sekisui Chemical Co. Ltd.) was used as a poly(vinyl butyral) resin. Further, 3-methyl-2-butanone/cyclohexanone=4/1 (V/V) was used as a mixed solution.

| | |
|---|---|
| Charge generation material: | 24 mass parts |
| Poly(vinyl butyral) resin: | 12 mass parts |
| Mixed solution: | 400 mass parts |

<Formation of Charge Transport Layer>

A charge transport layer coating solution in which the following components were mixed in the following amounts was applied to the surface of the charge generation layer by dip coating. Then the coated film was dried at 120° C. for 70 minutes to form a charge transport layer having a thickness of 24 μm on the charge generation layer. "Z300" (made by Mitsubishi Gas Chemical Co. Inc.) was used as a polycarbonate resin. IRGANOX™ 1010 (made by BASF Japan Co. Ltd.) was used as an antioxidant.

| | |
|---|---|
| Charge transport material (2): | 60 mass parts |
| Polycarbonate resin: | 100 mass parts |
| Antioxidant: | 4 mass parts |

Charge Transport Material (2)

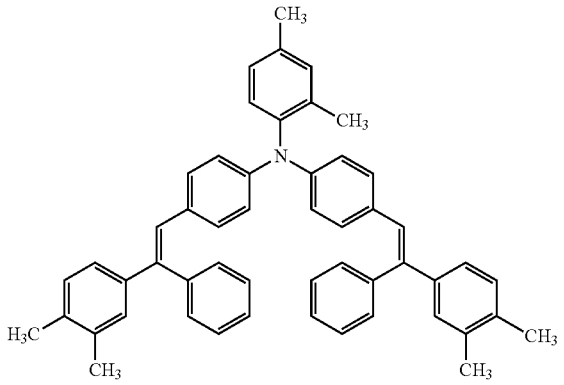

<Formation of Protective Layer>

A coating liquid for forming a protective layer was prepared by dissolving and dispersing the following materials in the following amounts. The obtained coating liquid (radical polymerizable resin composition) for forming a protective layer was applied on the charge transport layer with a circular slide hopper coating apparatus to form a coated layer. The coated layer was irradiated with UV rays with a metal halide lamp for 1 minute. Then the coated layer was dried to obtain a protective layer having a dry film thickness of 3.0 am. IRGACURE 819 (BASF Japan) was used as a polymerization initiator.

| | |
|---|---|
| Radical polymerizable monomer (M2): | 120 mass parts |
| Polymerization initiator: | 10 mass parts |
| 2-Butanol: | 400 mass parts |
| Inorganic fine particles 1 (alumina particles, Sumicorundum AA-03, made by Sumitomo Chemical Company Ltd.): | 100 mass parts |

[Preparation of Photoreceptors 2 to 8]

The photoreceptors 2 to 8 described above were prepared in the same manner as preparation of the photoreceptor 1 except that, the inorganic fine particles 1 (alumina particles, Sumicorundum AA-03, manufactured by Sumitomo Chemical Co., Ltd.) were changed to the respective inorganic fine particles described in Table III below. Note that the photoconductor 8 does not form a protective layer. Further, the inorganic fine particles 6 are silica particles 6 produced by the following method.

[Preparation of Silica Particles 6]

630 mass parts of methanol and 90 mass parts of water were added and mixed in a 5 liter reactor equipped with a stirrer, a dropping funnel and a thermometer. While this solution was stirred, 3,429 mass parts of tetramethoxysilane was hydrolyzed to obtain a suspension of silica fine particles. Subsequently, the mixture was heated to 60 to 70° C., and 390 mass parts of methanol was distilled off to obtain an aqueous suspension of silica fine particles. Thereafter, the solvent was distilled off under reduced pressure to prepare silica particles, whereby silica particles 6 having a number average particle size of 300 nm were obtained.

TABLE III

| Inorganic fine particles No. | Inorganic fine particles Kind | Name | Number average particle diameter (μm) |
|---|---|---|---|
| 1 | Alumina | Sumicorundum AA-03, made by Sumitomo Chemical Company Ltd. | 0.3 |
| 2 | Alumina | TAIMICRON TM-DA, made by Taimei Chemicals Co., Ltd. | 0.1 |
| 3 | Alumina | Sumicorundum AA-05, made by Sumitomo Chemical Company Ltd. | 0.5 |
| 4 | Alumina | AKP-G008, made by Sumitomo Chemical Company Ltd. | 0.08 |
| 5 | Alumina | Sumicorundum AA-07, made by Sumitomo Chemical Company Ltd. | 0.7 |
| 6 | Silica | Silica particles 6 | 0.3 |

TABLE IV

| Photoreceptor No. | Protective layer | Inorganic fine particles No. | Number average particle diameter (μm) of Inorganic fine particles |
|---|---|---|---|
| 1 | Present | 1 | 0.3 |
| 2 | Present | — | — |
| 3 | Present | 6 | 0.3 |
| 4 | Present | 2 | 0.1 |
| 5 | Present | 3 | 0.5 |
| 6 | Present | 4 | 0.08 |
| 7 | Present | 5 | 0.7 |
| 8 | Absent | — | — |

[Production of Toner Particles 1]

<Preparation of Dispersion Liquid of Styrene-Acryl (stac) Resin Particles>

(First Stage Polymerization)

Into a reaction vessel equipped with a stirrer, a temperature sensor, a cooling tube, and a nitrogen introducing device, a surfactant aqueous solution containing 4 mass parts of anionic surfactant containing sodium dodecyl sulfate ($C_{10}H_{21}(OCH_2CH_2)_2SO_3Na$) and 3,040 mass parts of ion-exchanged water were charged. Further, a polymerization initiator solution containing 10 mass parts of potassium persulfate (KPS) dissolved in 400 mass parts of ion-exchanged water was added thereto, and the liquid temperature was raised to 75° C. Subsequently, to this solution was dropwise added a polymerizable monomer solution containing 532 mass parts of styrene, 200 mass parts of n-butyl acrylate, 68 mass parts of methacrylic acid, and 16.4 mass parts of n-octyl mercaptan over 1 hour. After addition, the reaction system was heated and stirred at 75° C. for 2 hours to carry out the polymerization (first stage polymerization). Thus, a dispersion liquid of styrene-acryl resin particles was prepared. A weight average molecular weight (Mw) of the styrene-acryl resin particles in the dispersion liquid was 16,500.

A weight average molecular weight (Mw) of the resin was determined from the molecular weight distribution measured by gel permeation chromatography (GPC: Gel Permeation Chromatography). Specifically, the measurement sample was added to tetrahydrofuran (THF) to a concentration of 1 mg/mL, dispersed for 5 minutes using an ultrasonic disperser at room temperature, and then treated with a membrane filter with a pore size of 0.2 μm. Thus a sample solution was prepared. A measuring device "HLC-8120 GPC" (TOSOH Corp.) and a column set "TSK guard column+3×TSK gel Super HZM-M" (TOSOH Corp.) were used. The column temperature was held at 40° C., and tetrahydrofuran (THF) was supplied at a flow rate of 0.2 mL/min as a carrier solvent. An aliquot (10 μL) of the sample solution was injected into the GPC device along with the carrier solvent and was detected by means of a refractive index (RI) detector. The molecular weight distribution of the sample was calculated by using a calibration curve, which was determined by using standard polystyrene particles. The calibration curve was obtained by using 10 kinds of monodispersed polystyrene standard particles (manufactured by Pressure Chemical Co., Ltd.). The monodispersed polystyrene standard particles each have molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$.

(Second Stage Polymerization)

Into a reaction vessel equipped with a stirrer was added a polymerizable monomer solution containing 101.1 mass parts of styrene, 62.2 mass parts of n-butyl acrylate, 12.3 mass parts of methacrylic acid, and 1.75 mass parts of n-octyl mercaptan. Further, 93.8 mass parts of paraffin wax HNP-57 (manufactured by Nippon Seiro CO. Ltd.) as a release agent was added, and the inner temperature of the reaction vessel was heated to 90° C. to dissolve the mixture and prepared a monomer solution. In a separate vessel, a surfactant aqueous solution prepared by dissolving 3 mass parts of the anionic surfactant used in the first stage polymerization in 1,560 mass parts of ion-exchanged water was charged, and the mixture was heated to an internal temperature of 98° C. To this aqueous surfactant solution, 32.8 mass parts (in terms of solid content) of the dispersion liquid of styrene-acrylic resin particles obtained by the first stage polymerization was added and the monomer solution containing paraffin wax was further added. The reaction system was mixed and dispersed for 8 hours by using a mechanical disperser with a circulation route "CLEARMIX" (manufactured by M Technique Co., Ltd.) so that a dispersion liquid containing emulsion particles (oil particles) having a particle size of 340 nm was prepared.

To this dispersion, a polymerization initiator solution containing 6 mass parts of potassium persulfate dissolved in 200 mass parts of ion-exchanged water was added. Polymerization (second stage polymerization) was carried out by heating and stirring the system at 98° C. for 12 hours to prepare a dispersion liquid of styrene-acrylic resin particles. A weight average molecular weight (Mw) of the styrene-acryl resin particles in the dispersion liquid was 23,000.

(Third Stage Polymerization)

A polymerization initiator solution prepared by dissolving 5.45 mass parts of potassium persulfate in 220 mass parts of ion-exchanged water was added to the dispersion liquid of styrene-acrylic resin particles obtained in the second stage polymerization. To this dispersion, a polymerizable monomer solution containing 293.8 mass parts of styrene, 154.1 mass parts of n-butyl acrylate and 7.08 mass parts of n-octyl mercaptan was dropwise added at a temperature of 80° C. over 1 hour. After completion of the dropwise addition, polymerization was carried out by heating and stirring for 2 hours (third stage polymerization) and then cooled to 28° C. to obtain a dispersion liquid of styrene-acrylic resin particles. A weight average molecular weight (Mw) of the styrene-acryl resin particles in the dispersion liquid was 26,800.

<Dispersion Liquid of Amorphous Polyester Resin Particles>

Into a reaction vessel equipped with a stirring device, a nitrogen inlet tube, a temperature sensor and a rectifying column were placed the following: 139.5 mass parts of terephthalic acid and 15.5 mass parts of isophthalic acid as a polyvalent carboxylic acid monomer; 290.4 mass parts of 2-bis (4-hydroxyphenyl) propane propylene oxide 2 mol adduct (molecular weight=460) and 60.2 mass parts of 2,2-bis (4-hydroxyphenyl) propane ethylene oxide 2 mol adduct (molecular weight 404) as a polyhydric alcohol monomer. The temperature of the reaction system was increased to 190° C. over 1 hour, and after confirming that the inside of the reaction system was uniformly stirred, 3.21 mass parts of tin octylate was introduced as a catalyst. While distilling off the produced water, the temperature of the reaction system was raised from the same temperature to 240° C. over 6 hours, and the dehydrating condensation reaction was continued for 6 hours while maintaining the temperature at 240° C. to obtain an amorphous polyester resin. The amorphous polyester resin thus obtained had a peak molecular weight (Mp) of 12,000 and a weight average molecular weight (Mw) of 15,000. Methyl ethyl ketone and isopropyl alcohol were added to a reaction vessel equipped with anchor blades which give stirring power. Further, the crystalline polyester resin roughly pulverized by a hammer mill was gradually added, stirred, and completely dissolved to obtain a polyester resin solution to be an oil phase. Several drops of diluted aqueous ammonia solution were dropped into the stirred oil phase, then the oil phase was dropped into ion-exchanged water to effect phase inversion emulsification, and then the solvent was removed while reducing the pressure with an evaporator. Crystalline polyester resin particles were dispersed in the reaction system, and ion-exchanged water was added to the dispersion liquid to adjust the solid content to 20 mass % to prepare a dispersion liquid of crystalline polyester resin particles. A volume-based median diameter ($D_{50}$) of the amorphous polyester resin particles in the dispersion liquid was measured with a particle size distribution measuring instrument "Nanotrack Wave" (made by MicrotracBEL, Co. Ltd.). It was found to be 216 nm.

<Dispersion Liquid of Colorant Particles>

90 mass parts of sodium dodecyl sulfate was dissolved with stirring in 1,600 mass parts of ion-exchanged water. While stirring this solution, 420 mass parts of carbon black "REGAL 330R" (made by Cabot Corporation) was gradually added to the solution. Then, the dispersion liquid was dispersed with a stirrer "CLEAMIX" (made by M Technique Co., Ltd.) to prepare a dispersion liquid of colorant particles. A volume-based median diameter ($D_{50}$) of the colorant particles in the colorant particle dispersion liquid was measured with a particle size distribution measuring instrument "Nanotrack Wave" (made by MicrotracBEL, Corp.). It was found to be 117 nm.

[Production of Toner Mother Particles 1]

Into a reaction vessel equipped with a stirrer, a temperature sensor and a cooling tube were placed 300 mass parts (in terms of solid content) of styrene-acrylic resin particle dispersion liquid, 2,000 mass parts of ion-exchanged water. Then, a 5 (mol/L) sodium hydroxide aqueous solution was added to adjust the pH to 10. Thereafter 40 mass parts (in terms of solid content) of colorant dispersion liquid was placed in the reaction vessel. Next, an aqueous solution of 60 mass parts of magnesium chloride dissolved in 60 mass parts of ion-exchanged water was added with stirring at 30° C. over 10 minutes. The mixture was left still for 3 minutes. Thereafter, the temperature was raised to 80° C. over 60 minutes, and the grain growth reaction was continued while maintaining 80° C. In this condition, the particle size of the associated particles was measured by using a "MULTISIZER 3" (Beckman Coulter, Inc.). When the volume-based median diameter ($D_{50}$) reached 4.9 μm, 30 mass parts (in terms of solid content) of dispersion liquid of amorphous polyester resin particles were added over 30 minutes. When the supernatant of the reaction solution became transparent, an aqueous solution prepared by dissolving 190 mass parts of sodium chloride in 760 mass of ion-exchanged water was added to terminate particle growth. Then, the temperature of the reaction system was raised while stirring at 250 rpm, and heating and stirring was carried out at 90° C. to advance particle fusion. After 90 minutes, the mixture was cooled to 30° C. to prepare a dispersion liquid of toner mother particles.

The obtained dispersion liquid of toner mother particles was subjected to solid-liquid separation using a centrifuge. A wet cake of the toner mother particles was formed. This wet cake was washed with ion-exchanged water at 35° C. with the same centrifuge until the electric conductivity of the filtrate reached 5 μS cm. Thereafter, it was transferred to a Flash Jet Dryer (manufactured by Seishin Enterprise Co., Ltd.) and dried until the water content reached 0.5 mass %. Thus toner mother particles 1 were produced. The obtained toner mother particles 1 had a volume average particle diameter of 5.20 μm and a circularity of 0.965. The shape factor of the toner mother particles 1 was measured. The toner mother particles having a shape factor of 1.2 to 1.6 were 71.0% by number, and the variation coefficient of the shape factor was 12.0%.

[Production of Toner Mother Particles 2]

The toner mother particles 2 were produced in the same manner as production of the toner mother particles 1 except that the stirring rate from the addition of the magnesium chloride aqueous solution to the addition of the sodium chloride aqueous solution was performed at 190 rpm.

[Production of Toner Mother Particles 3]

The toner mother particles 3 were produced in the same manner as production of the toner mother particles 1 except that the stirring rate from the addition of the magnesium chloride aqueous solution to the addition of the sodium chloride aqueous solution was performed at 180 rpm.

[Production of Toner Mother Particles 4]

The toner mother particles 4 were produced in the same manner as production of the toner mother particles 1 except that the stirring rate from the addition of the magnesium chloride aqueous solution to the addition of the sodium chloride aqueous solution was performed at 170 rpm.

[Production of Toner Mother Particles 5]

The toner mother particles 5 were produced in the same manner as production of the toner mother particles 1 except that the stirring rate from the addition of the magnesium chloride aqueous solution to the addition of the sodium chloride aqueous solution was performed at 150 rpm.

[Production of Toner Mother Particles 6]

The toner mother particles 6 were produced in the same manner as production of the toner mother particles 1 except that the stirring rate after addition of the aqueous sodium chloride solution was changed to 200 rpm.

[Production of Toner Mother Particles 7]

The toner mother particles 7 were produced in the same manner as production of the toner mother particles 1 except that the stirring rate after addition of the aqueous sodium chloride solution was changed to 220 rpm.

[Production of Toner Mother Particles 8]

The toner mother particles 8 were produced in the same manner as production of the toner mother particles 1 except that the stirring rate after addition of the aqueous sodium chloride solution was changed to 230 rpm.

[Production of Toner Mother Particles 9]

The toner mother particles 9 were produced in the same manner as production of the toner mother particles 1 except that 30 mass parts of the amorphous polyester resin particle dispersion was added over 30 minutes in terms of solid content when the volume-based median diameter ($D_{50}$) reached 2.8 μm.

[Production of Toner Mother Particles 10]

The toner mother particles 10 were produced in the same manner as production of the toner mother particles 1 except that 30 mass parts of the amorphous polyester resin particle dispersion was added over 30 minutes in terms of solid content when the volume-based median diameter ($D_{50}$) reached 6.1 μm.

[Production of Toner Mother Particles 11]

The toner mother particles 11 were produced in the same manner as production of the toner mother particles 1 except that 30 mass parts of the amorphous polyester resin particle dispersion was added over 30 minutes in terms of solid content when the volume-based median diameter ($D_{50}$) reached 6.3 μm.

[Production of Toner Mother Particles 12]

The toner mother particles 12 were produced in the same manner as production of the toner mother particles 1 except that 30 mass parts of the amorphous polyester resin particle dispersion was added over 30 minutes in terms of solid content when the volume-based median diameter ($D_{50}$) reached 2.5 μm.

[Production of Toner Mother Particles 13]

The toner mother particles 13 were produced in the same manner as production of the toner mother particles 1 except that the stirring rate from the addition of the magnesium chloride aqueous solution to the addition of the sodium chloride aqueous solution was performed at 130 rpm.

[Production of Toner Mother Particles 14]

The toner mother particles 14 were produced in the same manner as production of the toner mother particles 1 except that the stirring rate from the addition of the magnesium chloride aqueous solution to the addition of the sodium chloride aqueous solution was performed at 230 rpm, and the stirring rate after addition of the aqueous sodium chloride solution was changed to 180 rpm.

[Production of Toner Particles 1]

<External Additive Treatment Process>

To the "toner mother particles 1" produced as described above, 2.0 mass parts of silica particles 1 and 0.8 mass parts of alumina particles 1 were added. Further, 0.8 mass parts of small size silica particles (HMDS treatment, hydrophobicity of 67, number average primary particle diameter of 12 nm) was added. The mixture was placed in a Henschel mixer model "FM 20C/I" (manufactured by Nippon Coke & Engineering Co., Ltd.) with setting the rotation number so that the blade tip circumferential speed was 50 m/s, and stirred for 20 minutes to obtain toner particles 1 containing the toner mother particles 1 treated with external additives. When the temperature became 41° C., cooling water was flowed into the outer bath of the Henschel mixer at a flow rate of 5 L/min, and when the temperature became 39° C., the cooling water was flowed at a flow rate of 1 L/min. Thus, temperature control inside the Henschel mixer was carried out. Thus the toner particles 1 were produced. The shape factor of the obtained toner particles 1 was measured. As a result, the number of toner particles having a shape factor of 1.2 to 1.6 was 71% by number, and the variation factor of the shape factor was 12%. Further, the volume average particle diameter of the toner particles was 5.2 μm, the same as that of the toner mother particles 1.

[Production of Toner Particles 2 to 36]

Toner particles 2 to 36 were prepared in the same manner as production of the toner particles 1 except that the toner mother particles, alumina particles, and silica particles were changed to the combinations indicated in Table V

[Production of Developer]

Developers 1 to 36 were respectively prepared by adding and mixing a ferrite carrier coated with a silicone resin and having a volume average particle diameter of 60 μm to the toner particles 1 to 36 so that the toner particle concentration is 6 mas %.

The number average particle diameter of alumina particles and silica particles, the shape factor and variation coefficient of toner particles, and the volume average particle diameter were measured by the methods described above.

TABLE V

| | | Toner particles | | | | | Alumina particles | | | Silica particles | | |
|---|---|---|---|---|---|---|---|---|---|---|---|---|
| | Developer No. | Toner particles No. | Toner mother particles No. | Content of toner particles having a shape factor in the range of 1.2 to 1.6 (% by number) | Variation coefficient of shape factor (%) | Volume average particle diameter of toner particles (μm) | No. | Number average particle diameter (nm) | Added amount (mass parts) | No. | Number average particle diameter (nm) | Added amount (mass parts) |
| *a 1 | 1 | 1 | 1 | 71.0 | 12.0 | 5.20 | 1 | 20 | 0.8 | 1 | 100 | 2.0 |
| *a 2 | 2 | 2 | 2 | 69.0 | 12.1 | 5.23 | 1 | 20 | 0.8 | 1 | 100 | 2.0 |
| *a 3 | 3 | 3 | 3 | 65.0 | 12.3 | 5.12 | 1 | 20 | 0.8 | 1 | 100 | 2.0 |
| *a 4 | 4 | 4 | 4 | 64.0 | 12.5 | 5.10 | 1 | 20 | 0.8 | 1 | 100 | 2.0 |
| *a 5 | 5 | 5 | 5 | 50.0 | 12.9 | 5.08 | 1 | 20 | 0.8 | 1 | 100 | 2.0 |
| *a 6 | 6 | 6 | 6 | 70.0 | 15.9 | 5.19 | 1 | 20 | 0.8 | 1 | 100 | 2.0 |
| *a 7 | 7 | 7 | 7 | 70.4 | 14.0 | 5.24 | 1 | 20 | 0.8 | 1 | 100 | 2.0 |
| *a 8 | 8 | 8 | 8 | 70.2 | 14.2 | 5.22 | 1 | 20 | 0.8 | 1 | 100 | 2.0 |
| *a 9 | 9 | 9 | 9 | 70.1 | 12.2 | 3.10 | 1 | 20 | 0.8 | 1 | 100 | 2.0 |
| *a 10 | 10 | 10 | 10 | 70.5 | 11.9 | 6.45 | 1 | 20 | 0.8 | 1 | 100 | 2.0 |
| *a 11 | 11 | 11 | 11 | 70.4 | 11.8 | 6.61 | 1 | 20 | 0.8 | 1 | 100 | 2.0 |
| *a 12 | 12 | 12 | 12 | 70.0 | 12.4 | 2.85 | 1 | 20 | 0.8 | 1 | 100 | 2.0 |
| *a 13 | 13 | 13 | 1 | 71.0 | 12.0 | 5.20 | 2 | 5.1 | 0.8 | 1 | 100 | 2.0 |
| *a 14 | 14 | 14 | 1 | 71.0 | 12.0 | 5.20 | 3 | 59 | 0.8 | 1 | 100 | 2.0 |
| *a 15 | 15 | 15 | 1 | 71.0 | 12.0 | 5.20 | 4 | 9 | 0.8 | 1 | 100 | 2.0 |
| *a 16 | 16 | 16 | 1 | 71.0 | 12.0 | 5.20 | 5 | 10 | 0.8 | 1 | 100 | 2.0 |
| *a 17 | 17 | 17 | 1 | 71.0 | 12.0 | 5.20 | 6 | 25 | 0.8 | 1 | 100 | 2.0 |
| *a 18 | 18 | 18 | 1 | 71.0 | 12.0 | 5.20 | 7 | 27 | 0.8 | 1 | 100 | 2.0 |
| *a 19 | 19 | 19 | 1 | 71.0 | 12.0 | 5.20 | 1 | 20 | 0.08 | 1 | 100 | 2.0 |
| *a 20 | 20 | 20 | 1 | 71.0 | 12.0 | 5.20 | 1 | 20 | 0.1 | 1 | 100 | 2.0 |
| *a 21 | 21 | 21 | 1 | 71.0 | 12.0 | 5.20 | 1 | 20 | 3.0 | 1 | 100 | 2.0 |
| *a 22 | 22 | 22 | 1 | 71.0 | 12.0 | 5.20 | 1 | 20 | 3.2 | 1 | 100 | 2.0 |
| *a 23 | 23 | 23 | 1 | 71.0 | 12.0 | 5.20 | 1 | 20 | 0.8 | 2 | 81 | 2.0 |
| *a 24 | 24 | 24 | 1 | 71.0 | 12.0 | 5.20 | 1 | 20 | 0.8 | 3 | 198 | 2.0 |
| *a 25 | 25 | 25 | 1 | 71.0 | 12.0 | 5.20 | 1 | 20 | 0.8 | 1 | 100 | 0.08 |
| *a 26 | 26 | 26 | 1 | 71.0 | 12.0 | 5.20 | 1 | 20 | 0.8 | 1 | 100 | 0.1 |
| *a 27 | 27 | 27 | 1 | 71.0 | 12.0 | 5.20 | 1 | 20 | 0.8 | 1 | 100 | 3.0 |
| *a 28 | 28 | 28 | 1 | 71.0 | 12.0 | 5.20 | 1 | 20 | 0.8 | 1 | 100 | 3.2 |
| *a 29 | 1 | 1 | 1 | 71.0 | 12.0 | 5.20 | 1 | 20 | 0.8 | 1 | 100 | 2.0 |
| *a 30 | 1 | 1 | 1 | 71.0 | 12.0 | 5.20 | 1 | 20 | 0.8 | 1 | 100 | 2.0 |
| *a 31 | 1 | 1 | 1 | 71.0 | 12.0 | 5.20 | 1 | 20 | 0.8 | 1 | 100 | 2.0 |

TABLE V-continued

| | | Toner particles | | | | | Alumina particles | | | Silica particles | | |
|---|---|---|---|---|---|---|---|---|---|---|---|---|
| | Developer No. | Toner particles No. | Toner mother particles No. | Content of toner particles having a shape factor in the range of 1.2 to 1.6 (% by number) | Variation coefficient of shape factor (%) | Volume average particle diameter of toner particles (μm) | No. | Number average particle diameter (nm) | Added amount (mass parts) | No. | Number average particle diameter (nm) | Added amount (mass parts) |
| *a 32 | 1 | 1 | 1 | 71.0 | 12.0 | 5.20 | 1 | 20 | 0.8 | 1 | 100 | 2.0 |
| *a 33 | 1 | 1 | 1 | 71.0 | 12.0 | 5.20 | 1 | 20 | 0.8 | 1 | 100 | 2.0 |
| *a 34 | 1 | 1 | 1 | 71.0 | 12.0 | 5.20 | 1 | 20 | 0.8 | 1 | 100 | 2.0 |
| *b 1 | 29 | 29 | 13 | 49.1 | 12.0 | 5.20 | 1 | 20 | 0.8 | 1 | 100 | 2.0 |
| *b 2 | 30 | 30 | 14 | 72.4 | 16.2 | 5.20 | 1 | 20 | 0.8 | 1 | 100 | 2.0 |
| *b 3 | 31 | 31 | 1 | 71.0 | 12.0 | 5.20 | 8 | 4 | 0.8 | 1 | 100 | 2.0 |
| *b 4 | 32 | 32 | 1 | 71.0 | 12.0 | 5.20 | 9 | 63 | 0.8 | 1 | 100 | 2.0 |
| *b 5 | 33 | 33 | 1 | 71.0 | 12.0 | 5.20 | — | — | 0 | 1 | 100 | 2.0 |
| *b 6 | 34 | 34 | 1 | 71.0 | 12.0 | 5.20 | 1 | 20 | 0.8 | 4 | 72 | 2.0 |
| *b 7 | 35 | 35 | 1 | 71.0 | 12.0 | 5.20 | 1 | 20 | 0.8 | 5 | 210 | 2.0 |
| *b 8 | 36 | 36 | 1 | 71.0 | 12.0 | 5.20 | 1 | 20 | 0.8 | — | — | 0.0 |
| *b 9 | 1 | 1 | 1 | 71.0 | 12.0 | 5.20 | 1 | 20 | 0.8 | — | — | 0.0 |

*a: Example
*b: Comparative example

[Evaluation]

The developer and the photoreceptor produced were mounted in the image forming apparatus AccurioPress C3070 (manufactured by Konica Minolta, Inc.) in combinations described in Table VI, and this was used as an evaluation machine. After conditioning this evaluation machine at 30° C. and 80% RH overnight, initial cleaning properties and image density were evaluated. Next, 350,000 sheets were printed to form a strip-shaped solid image having a printing rate of 5% on high-quality paper (65 g/m$^2$) of A4 size plate, and further, 150,000 sheets were printed to form a belt-like solid image with a printing rate of 40%. Thereafter, evaluation of cleaning property, image density, image flow, and in-machine contamination was performed. Each evaluation method was performed as follows.

<Cleaning Property>

After outputting a character image and a patch image with a printing rate of 10%, the surface of the photoreceptor was visually observed to evaluate the degree of toner slipping. The evaluation criteria AA, BB and CC are acceptable.

(Evaluation Criteria)

AA: Good with no toner slipping

BB: Toner slipping is slightly observed, but there is no practical problem

CC: Toner slipping is slightly observed and image defect occurs slightly

DD: Toner slip occurs and there are practical problems

<Image Density>

A solid image of 10 cm square was printed, and the image density was measured at 10 random locations with a reflection densitometer "RD-918 (manufactured by Macbeth Co.)", and the average density was evaluated. The evaluation criteria AA, BB and CC are acceptable.

(Evaluation Criteria)

AA: The absolute value of the difference in image density between the initial print and 500,000 prints is less than 0.06

BB: The absolute value of the image density difference between the initial print and 500,000 prints is 0.06 or more and less than 0.10

CC: Absolute value of difference in image density after initial printing and after printing 500,000 sheets is 0.10 or more and less than 0.15

DD: The absolute value of the difference in image density after initial printing and after printing 500,000 sheets is 0.15 or more <Image Flow>

The main power of the image forming apparatus was turned off immediately after outputting 500,000 sheets, and the main power was turned on 12 hours after the main power was turned off. Immediately after printing was possible, a halftone image (relative reflection density of 0.4 with a Macbeth densitometer) and an entire 6-dot lattice image were printed on the entire surface of neutral paper of A3 size. The state of the printed image was visually observed and evaluated according to the following evaluation criteria. The evaluation criteria AA, BB and CC are acceptable.

(Evaluation Criteria)

AA: Image flow does not occur in both halftone image and grid image

BB: A thin strip density decrease in the long axis direction of the photoreceptor is observed only in the halftone image CC: Thin band-like density decrease is recognized for both halftone image and grid image DD: Grid image loss or thin line width due to image flow is observed <In-Machine Contamination>

The contamination around the fixing device after printing 500,000 sheets was visually evaluated according to the following criteria.

(Evaluation Criteria)

AA (Very good): No noticeable contamination around the fixing unit

BB (Good): A small amount of contamination is observed around the fixing device

CC (Normal): The spread of contamination is clearly observed in the fixing guide portion DD (Bad): A considerable amount of contamination is noticeable around the fixing unit.

TABLE VI

| | Developer No. | Photoreceptor No. | Evaluation: Initial stage Cleaning property | After performing 500,000 prints: Cleaning property | Difference in image density before and after durability test (Numerical value) | Difference in image density before and after durability test (Judgement) | Image flow | In-machine contamination |
|---|---|---|---|---|---|---|---|---|
| *a 1 | Developer 1 | Photoreceptor 1 | AA | AA | 0.01 | AA | AA | AA |
| *a 2 | Developer 2 | Photoreceptor 1 | AA | BB | 0.07 | BB | AA | AA |
| *a 3 | Developer 3 | Photoreceptor 1 | AA | BB | 0.08 | BB | BB | BB |
| *a 4 | Developer 4 | Photoreceptor 1 | AA | CC | 0.09 | BB | BB | BB |
| *a 5 | Developer 5 | Photoreceptor 1 | BB | CC | 0.13 | CC | CC | CC |
| *a 6 | Developer 6 | Photoreceptor 1 | BB | CC | 0.14 | CC | CC | CC |
| *a 7 | Developer 7 | Photoreceptor 1 | AA | AA | 0.02 | AA | AA | BB |
| *a 8 | Developer 8 | Photoreceptor 1 | AA | BB | 0.04 | AA | AA | BB |
| *a 9 | Developer 9 | Photoreceptor 1 | BB | CC | 0.08 | BB | BB | AA |
| *a 10 | Developer 10 | Photoreceptor 1 | AA | AA | 0.05 | AA | AA | BB |
| *a 11 | Developer 11 | Photoreceptor 1 | AA | AA | 0.08 | BB | AA | BB |
| *a 12 | Developer 12 | Photoreceptor 1 | CC | CC | 0.09 | BB | CC | AA |
| *a 13 | Developer 13 | Photoreceptor 1 | AA | AA | 0.10 | CC | CC | CC |
| *a 14 | Developer 14 | Photoreceptor 1 | AA | AA | 0.13 | CC | AA | BB |
| *a 15 | Developer 15 | Photoreceptor 1 | AA | AA | 0.06 | BB | BB | CC |
| *a 16 | Developer 16 | Photoreceptor 1 | AA | AA | 0.04 | AA | AA | AA |
| *a 17 | Developer 17 | Photoreceptor 1 | AA | AA | 0.03 | AA | AA | AA |
| *a 18 | Developer 18 | Photoreceptor 1 | AA | AA | 0.06 | BB | AA | BB |
| *a 19 | Developer 19 | Photoreceptor 1 | AA | AA | 0.11 | CC | CC | CC |
| *a 20 | Developer 20 | Photoreceptor 1 | AA | AA | 0.07 | BB | BB | BB |
| *a 21 | Developer 21 | Photoreceptor 1 | AA | AA | 0.09 | BB | AA | AA |
| *a 22 | Developer 22 | Photoreceptor 1 | AA | AA | 0.14 | CC | AA | AA |
| *a 23 | Developer 23 | Photoreceptor 1 | AA | AA | 0.03 | AA | BB | BB |
| *a 24 | Developer 24 | Photoreceptor 1 | AA | AA | 0.05 | AA | CC | BB |
| *a 25 | Developer 25 | Photoreceptor 1 | AA | AA | 0.04 | AA | CC | CC |
| *a 26 | Developer 26 | Photoreceptor 1 | AA | AA | 0.03 | AA | CC | CC |
| *a 27 | Developer 27 | Photoreceptor 1 | AA | AA | 0.03 | AA | BB | BB |
| *a 28 | Developer 28 | Photoreceptor 1 | AA | AA | 0.05 | AA | CC | BB |
| *a 29 | Developer 1 | Photoreceptor 2 | AA | CC | 0.14 | CC | AA | AA |
| *a 30 | Developer 1 | Photoreceptor 3 | AA | BB | 0.07 | BB | BB | AA |
| *a 31 | Developer 1 | Photoreceptor 4 | AA | BB | 0.05 | AA | AA | AA |
| *a 32 | Developer 1 | Photoreceptor 5 | AA | AA | 0.12 | CC | AA | AA |
| *a 33 | Developer 1 | Photoreceptor 6 | AA | BB | 0.07 | BB | AA | AA |
| *a 34 | Developer 1 | Photoreceptor 7 | AA | BB | 0.14 | CC | AA | AA |
| *b 1 | Developer 29 | Photoreceptor 1 | BB | CC | 0.14 | CC | DD | DD |
| *b 2 | Developer 30 | Photoreceptor 1 | BB | CC | 0.15 | DD | CC | DD |
| *b 3 | Developer 31 | Photoreceptor 1 | AA | BB | 0.12 | CC | DD | CC |
| *b 4 | Developer 32 | Photoreceptor 1 | AA | AA | 0.17 | DD | AA | CC |
| *b 5 | Developer 33 | Photoreceptor 1 | AA | BB | 0.19 | DD | DD | DD |
| *b 6 | Developer 34 | Photoreceptor 1 | AA | AA | 0.06 | BB | DD | CC |
| *b 7 | Developer 35 | Photoreceptor 1 | AA | AA | 0.05 | AA | DD | CC |
| *b 8 | Developer 36 | Photoreceptor 1 | AA | AA | 0.07 | BB | DD | CC |
| *b 9 | Developer 1 | Photoreceptor 8 | AA | DD | 0.30 | DD | CC | CC |

*a: Example

*b: Comparative example

From the above results, it can be seen that the image forming method of the present invention is superior to the image forming method of the comparative example in terms of cleaning properties, image density and image flow, and suppression of in-machine contamination during long-term continuous use.

Although the embodiments of the present invention have been described and illustrated in detail, it is clearly understood that the same is by way of illustration and example only and not limitation, the scope of the present invention should be interpreted by terms of the appended claims.

What is claimed is:

1. An image forming method, comprising:

charging an electrophotographic photoreceptor;

forming an electrostatic latent image on the electrophotographic photoreceptor;

developing the electrostatic latent image with a toner to form a toner image;

transferring the toner image to a transfer material;

fixing the toner image on the transfer material;

cleaning the electrophotographic photoreceptor, wherein the electrophotographic photoreceptor comprises a photosensitive layer and a protective layer in this order on a conductive support, the protective layer contains at least a cured resin obtained by curing a polymerizable compound; the toner contains 50% by number or more of toner particles having a shape factor calculated by the following equation (1) in the range of 1.2 to 1.6, and a variation coefficient of the shape factor is 16% or less; and the toner contains alumina particles having a number average particle diameter in the range of 5 to 60 nm and silica particles having a number average particle diameter in the range of 80 to 200 nm, $$\text{Shape factor}=[(\text{Maximum diameter}/2)^2\times\pi)]/(\text{Projection area}) \quad \text{Equation (1):}$$

wherein "Maximum diameter" indicates a width of a particle that maximizes an interval between two parallel lines when a projected image of the toner particles on a plane is sandwiched between the two parallel lines; and "Projection area" indicates an area of the projected image of the toner particles on the plane.

2. The image forming method described in claim 1, wherein the toner contains 65% by number or more of toner particles having the shape factor in the range of 1.2 to 1.6.

3. The image forming method described in claim 1, wherein a content of the alumina particles is in the range of 0.1 to 3.0 mass parts with respect to the whole toner mother particles.

4. The image forming method described in claim 1, wherein a content of the silica particles is in the range of 0.1 to 3.0 mass parts with respect to the whole toner mother particles.

5. The image forming method described in claim 1, wherein a volume average particle diameter of the toner particles is in the range of 3.0 to 6.5 μm.

6. The image forming method described in claim 1, wherein the protective layer contains at least inorganic fine particles.

7. The image forming method described in claim 6, wherein a number average particle diameter of the inorganic fine particles is in the range of 0.1 to 0.5 μm.

8. The image forming method described in claim 6, wherein the inorganic fine particles contain at least alumina particles.

* * * * *